US012765741B2

(12) United States Patent
Li et al.

(10) Patent No.: US 12,765,741 B2
(45) Date of Patent: Oct. 20, 2026

(54) WASHING CONTROL METHOD AND APPARATUS, COMPUTER READABLE STORAGE MEDIUM, AND ELECTRONIC DEVICE

(71) Applicant: Beijing Roborock Technology Co., Ltd., Beijing (CN)

(72) Inventors: Xing Li, Beijing (CN); Chuanlin Duan, Beijing (CN); Song Peng, Beijing (CN); Yixing Wang, Beijing (CN); Jingtao Jia, Beijing (CN); Qi Wu, Beijing (CN); Xinyu Han, Beijing (CN)

(73) Assignee: Beijing Roborock Technology Co., Ltd., Beijing (CN)

( * ) Notice: Subject to any disclaimer, the term of this patent is extended or adjusted under 35 U.S.C. 154(b) by 651 days.

(21) Appl. No.: 18/266,785

(22) PCT Filed: Sep. 15, 2021

(86) PCT No.: PCT/CN2021/118572
§ 371 (c)(1),
(2) Date: Jun. 12, 2023

(87) PCT Pub. No.: WO2022/121425
PCT Pub. Date: Jun. 16, 2022

(65) Prior Publication Data

US 2024/0049938 A1 Feb. 15, 2024

(30) Foreign Application Priority Data

Dec. 11, 2020 (CN) ..... 202011461107.8
Aug. 18, 2021 (CN) ..... 202110948745.0

(51) Int. Cl.
*A47L 11/40* (2006.01)

(52) U.S. Cl.
CPC ..... *A47L 11/4091* (2013.01); *A47L 11/4011* (2013.01); *A47L 2201/022* (2013.01); *A47L 2201/024* (2013.01); *A47L 2201/028* (2013.01)

(58) Field of Classification Search
CPC ..... A47L 11/4091; A47L 11/4011; A47L 2201/022; A47L 2201/024; A47L 2201/028
See application file for complete search history.

(56) References Cited

U.S. PATENT DOCUMENTS

2018/0249872 A1 9/2018 Park
2020/0077858 A1 3/2020 Zhang et al.
(Continued)

FOREIGN PATENT DOCUMENTS

CN 105686766 A 6/2016
CN 106264342 A 1/2017
(Continued)

OTHER PUBLICATIONS

Office Action dated Sep. 26, 2022, issued in corresponding Chinese Patent Application No. 202110948745.0.
(Continued)

*Primary Examiner* — Andrew A Horton
(74) *Attorney, Agent, or Firm* — Morgan, Lewis & Bockius LLP

(57) ABSTRACT

A washing control method and apparatus for a cleaning device or a cleaning system, a computer-readable storage medium and an electronic device are disclosed and relate to the field of smart control technologies.

19 Claims, 11 Drawing Sheets

(56) References Cited

U.S. PATENT DOCUMENTS

| | | | |
|---|---|---|---|
| 2020/0345195 | A1 | 11/2020 | Zhou |
| 2020/0359868 | A1 | 11/2020 | Bo |

FOREIGN PATENT DOCUMENTS

| | | | | |
|---|---|---|---|---|
| CN | 106308685 | A | 1/2017 | |
| CN | 108464774 | A | 8/2018 | |
| CN | 109245205 | A | 1/2019 | |
| CN | 109528094 | A | 3/2019 | |
| CN | 109528111 | A | 3/2019 | |
| CN | 109772841 | A | 5/2019 | |
| CN | 110353572 | A | 10/2019 | |
| CN | 209629585 | U | 11/2019 | |
| CN | 209808228 | U | 12/2019 | |
| CN | 110754991 | A | 2/2020 | |
| CN | 110916569 | A | 3/2020 | |
| CN | 111466838 | A | 7/2020 | |
| CN | 111588310 | A | 8/2020 | |
| CN | 111820824 | A | 10/2020 | |
| CN | 111839375 | A | 10/2020 | |
| CN | 111839383 | A | 10/2020 | |
| CN | 111920349 | A | 11/2020 | |
| CN | 111973090 | A | 11/2020 | |
| CN | 211862711 | U | 11/2020 | |
| CN | 112006618 | A | 12/2020 | |
| EA | 36313 | B1 | 10/2020 | |
| EP | 3542695 | A1 * | 9/2019 | ..... A47L 11/40 |
| JP | 2015-528275 | A | 9/2015 | |
| JP | 2018-500998 | A | 1/2018 | |
| JP | 2018-196511 | A | 12/2018 | |
| JP | 2020500676 | A | 1/2020 | |
| KR | 10-0657737 | B1 | 12/2006 | |
| KR | 10-0692896 | B1 | 3/2007 | |
| KR | 10-2019-0099407 | A | 8/2019 | |
| RU | 2106268 | C1 | 3/1998 | |
| WO | 2017/177672 | A1 | 10/2017 | |
| WO | 2018/107465 | A1 | 6/2018 | |
| WO | 2019/177418 | A1 | 9/2019 | |

OTHER PUBLICATIONS

International Search Report issued in corresponding International Patent Application No. PCT/CN2021/118572 dated Dec. 15, 2021.

Office Action issued in corresponding Korean Patent Application No. 10-2023-7023136, dated Nov. 29, 2024.

Office Action issued in corresponding Japanese Patent Application No. 2024-066259, dated Jun. 24, 2025.

Reconsideration Report by Examiner before Appeal issued in corresponding Japanese Patent Application No. 2023-535604, dated Mar. 18, 2025.

Office Action issued in the counterpart CN Application No. 202011461107.8, dated May 30, 2024.

Office Action issued in the corresponding AU Application No. 2021397991, mailed Sep. 10, 2024.

Reconsideration Report by Examiner before Appeal issued in corresponding Japanese Patent Application No. 2024-066259, dated Jul. 28, 2026.

Extended European Search Report dated Apr. 20, 2026 issued in the corresponding European Patent Application No. 26152298.1.

* cited by examiner

WASHING CONTROL METHOD AND APPARATUS, COMPUTER READABLE STORAGE MEDIUM, AND ELECTRONIC DEVICE

This application is a 35 U.S.C. 371 national phase application of PCT International Application No. PCT/CN2021/118572 filed on Sep. 15, 2021, which PCT International Application claims priority to Chinese Patent Application No. 202011461107.8 and 202110948745.0, filed on Dec. 11, 2020 and Aug. 18, 2021 respectively, which are all incorporated herein by reference in their entireties.

TECHNICAL FIELD

The present disclosure relates to the field of smart control technologies, and in particular to a washing control method and apparatus for a cleaning device or cleaning system, a computer-readable storage medium and an electronic device.

BACKGROUND

With the rise of smart homes, smart household appliances have gradually entered people's daily home life, and a variety of automatic cleaning devices, such as automatic sweeping robots and automatic mopping robots, has also appeared. As an intelligent cleaning device that can automatically complete cleaning work such as cleaning, vacuuming and mopping, sweeping robots have become a must for many families.

However, most of the existing sweeping robots are only responsible for cleaning the house. After the cleaning is completed, the cleaning of the sweeping robot itself is ignored. Usually, the user is required to manually wash the mop, the sweeping brushes and other components of the sweeping robot, which is troublesome to operate and brings a lot of inconvenience to the user.

It should be noted that the information disclosed in the above Background section is only for enhancement of understanding of the background of the present disclosure, and therefore may contain information that does not form the prior art that is already known to a person of ordinary skill in the art.

SUMMARY

An object of the present disclosure is to provide a washing control method and apparatus for a cleaning assembly of a cleaning device, a computer-readable storage medium and an electronic device, which in a certain degree can overcome the restrictions and shortcomings in the related arts that a cleaning device cannot automatically wash its cleaning assembly and the use of the cleaning device is inconvenient.

According to a first aspect of the present disclosure, a washing control method for a cleaning assembly of a cleaning device is provided. The method includes: after the cleaning device enters a charging pile with a first posture, controlling a washing assembly on the charging pile to perform a washing task on the cleaning assembly of the cleaning device; and if the washing task is the last washing task of a cleaning process, then, after the washing task is completed, controlling the cleaning device to exit from the charging pile, and controlling the cleaning device to enter the charging pile with a second posture which is different from the first posture.

According to another aspect of the present disclosure, a washing control apparatus for a cleaning assembly of a cleaning device is provided. The apparatus includes: a first posture control module and a second posture control module.

In particular, the first posture control module may be configured to: after the cleaning device enters a charging pile with a first posture, control a washing assembly on the charging pile to perform a washing task on the cleaning assembly of the cleaning device. The second posture control module may be configured to: if the washing task is the last washing task of a, cleaning process, then, after the washing task is completed, control the cleaning device to exit from the charging pile, and control the cleaning device to enter the charging pile with a second posture which is different from the first posture.

According to yet another aspect of the present disclosure, a control method for a cleaning system is provided. The cleaning system includes a cleaning device and a charging pile. The method includes: acquiring a current working state of the cleaning device; after determining that the cleaning device is in a preset working state, determining a relative position of the cleaning device with respect to the charging pile; and applying a driving force to a driving wheel of the cleaning device based on the relative position so as to control the cleaning device to move with respect to the charging pile or to be kept at the charging pile.

According to yet another aspect of the present disclosure, a control apparatus for a cleaning system is provided. The cleaning system includes a cleaning device and a charging pile. The apparatus includes: an acquisition module configured to acquire a current working state of the cleaning device; a determination module configured to, after determining that the cleaning device is in a preset working state, determine a relative position of the cleaning device with respect to the charging pile; and a driving module configured to apply a driving force to a driving wheel of the cleaning device based on the relative position so as to control the cleaning device to move with respect to the charging pile or to be kept at the charging pile.

According to yet another aspect of the present disclosure, a storage medium storing a computer program thereon is provided. When the computer program is executed by a processor, any of the above washing control method for a cleaning assembly of a cleaning device is realized, or any of the above control method for a cleaning system is realized.

According to yet another aspect of the present disclosure, an electronic device is provided. The electronic device includes a processor and a memory for storing an instruction executable by the processor, wherein the processor is configured to execute the executable instruction to perform any of the above washing control method for a cleaning assembly of a cleaning device.

Understandably, the foregoing general description and the following detailed description are only exemplary and explanatory, and do not limit the present disclosure.

BRIEF DESCRIPTION OF THE DRAWINGS

The accompanying drawings incorporated in the description and forming a part thereof illustrate the embodiments consistent with the present disclosure and are used to explain the principle of the present disclosure along with the description. Apparently, the drawings in the description below are merely for illustrating some embodiments of the present disclosure, and other drawings may be obtained by those of ordinary skill in the art according to these drawings without paying any creative labor. In the drawings.

DETAILED DESCRIPTION

Figure 1:
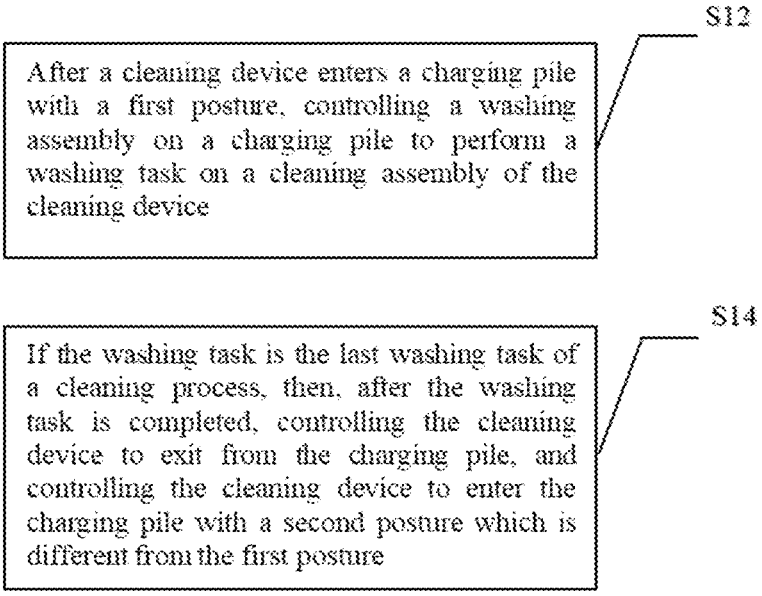
FIG. 1 is a schematic diagram illustrating the flowchart of a washing control method for a cleaning assembly of a cleaning device in accordance with an exemplary embodiment of the present disclosure.

The exemplary embodiments are described more comprehensively below with reference to the accompanying drawings. However, the exemplary embodiments can be implemented in many forms and should not be construed as limited to the examples set forth herein. On the contrary, these embodiments provided will enable the present disclosure to be more thorough and complete, and fully convey the scope of the exemplary embodiments to those skilled in the art. The features, structures, or characteristics described may be combined in one or more embodiments in any suitable manner. In the following description, numerous specific details are provided so as to give a thorough understanding of the embodiments of the present disclosure. However, those skilled in the art will recognize that the technical solutions of the present disclosure may be practicable in the event of omitting one or more of the specific details, or adopting other methods, components, apparatuses, steps, etc. In other cases, well-known technical solutions are not shown or described in detail to avoid obscuring of all aspects of the present disclosure.

Furthermore, the drawings are merely schematic illustrations of the present disclosure and are not necessarily drawn to scale. The same reference numerals in the drawings denote the same or similar parts, and thus their repeated descriptions will be omitted. Some of the block diagrams shown in the drawings are functional entities that do not necessarily correspond to physically or logically separate entities. These functional entities may be implemented by software, or in one or more hardware modules or integrated circuits, or in different networks and/or processor devices and/or microcontroller devices.

The flowcharts shown in the drawings are merely illustrative and do not necessarily include all steps. For example, some steps can be decomposed, and some steps can be combined or partially combined, so the actual execution order may be changed according to the actual situation.

With the improving of people's living standards, sweeping robots have been gradually brought into common people's homes, and are increasingly accepted by people. In the near future, the sweeping robot will become a cleaning helper which is essential tier every family as an ordinary household appliance such as a TV and an air conditioner. The existing intelligent sweeping robot will be developed to a higher-intelligent one to replace manual cleaning stepwise. However, the sweeping robot in the prior art cleans dust and dirt with a hairbrush or mop which needs to be manually cleaned after use, causing inconvenience in use and waste of a lot of time.

FIG. 1 is a schematic diagram illustrating the flowchart of a washing control method for a cleaning assembly of a cleaning device in accordance with an exemplary embodiment of the present disclosure. Referring to FIG. 1, a washing control method for a cleaning assembly of a cleaning device includes the following steps.

In S12, after the cleaning device enters a charging pile with a first posture, a washing assembly on the charging pile is controlled to perform a washing task on the cleaning assembly of the cleaning device.

In an exemplary embodiment of the present disclosure, the cleaning device refers to a device such as a sweeping robot and a vacuum cleaner which are used to complete a house cleaning task. The cleaning device may be a sweeping and mopping robot, may perform a sweeping function or a mopping function separately, and may perform the sweeping and mopping functions at the same time. The first posture refers to a posture in which a front surface of the robot faces the charging pile. After the robot enters the charging pile with the first posture, the cleaning assembly with the mopping function can be cleaned upon entering a washing tank on the charging pile.

Figure 2:
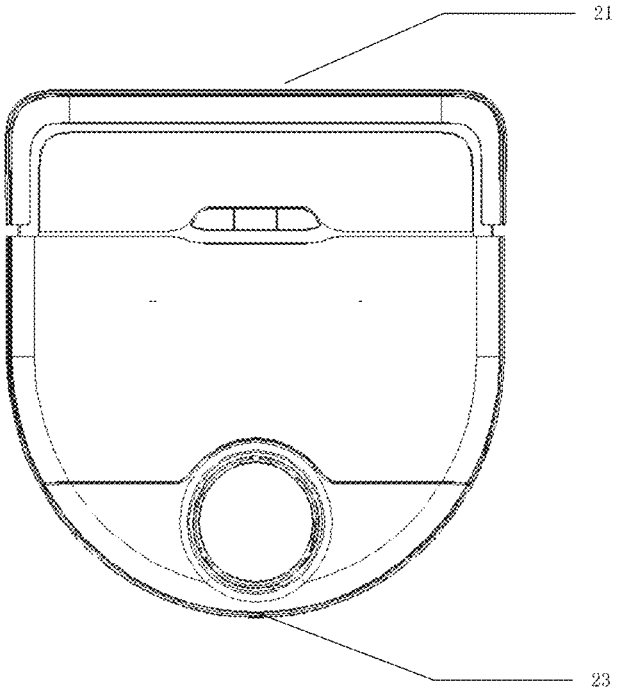
FIG. 2 is a schematic diagram illustrating the shape of a cleaning device in accordance with an exemplary embodiment of the present disclosure.

FIG. 2 is a schematic diagram illustrating the shape of a cleaning device in accordance with an exemplary embodiment of the present disclosure. As shown in FIG. 2, the front surface 21 of the cleaning device is a surface facing the charging pile when the cleaning device enters the charging pile with the first posture; and a back surface 22 of the cleaning device is a surface facing the charging pile when the cleaning device enters the charging pile with a second posture. Besides the shape shown in FIG. 2, the cleaning device of the present disclosure may also be round, oval and the like, which are not limited in the present disclosure.

Figure 3:
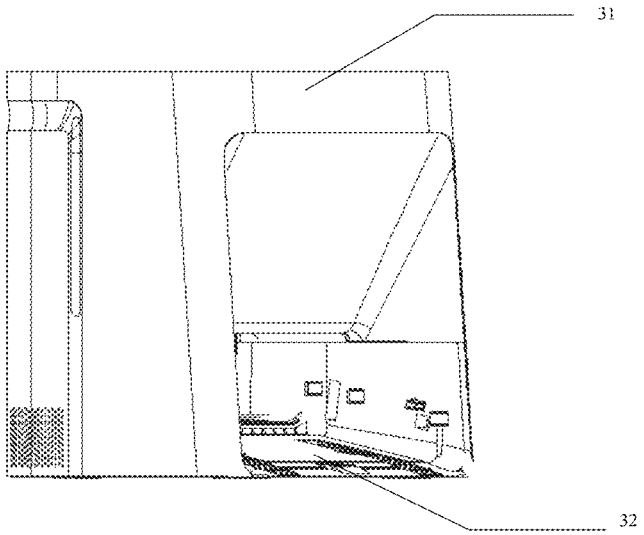
FIG. 3 is a schematic diagram illustrating the shape of a charging pile in accordance with an exemplary embodiment of the present disclosure.

The charging pile refers to a device that can charge and clean the cleaning device, FIG. 3 is a schematic diagram illustrating the shape of a charging pile in accordance with an exemplary embodiment of the present disclosure. As shown in FIG. 3, the charging pile includes a pile body 31 and an entrance 32. The washing assembly is arranged on the pile body 31, and the entrance 32 is used to enable the cleaning device to enter the charging pile. The shape of the charging pile in the present disclosure may be others besides that shown in FIG. 3, such as a cuboid, a cube and an ellipsoid, which are not limited in the present disclosure. The washing assembly on the charging pile refers to one or more modules for washing the cleaning device, and may include a clean water pump, a clean water tank, a wastewater pump, a wastewater tank, a washing tank, etc. The cleaning assembly on the cleaning device refer to a sweeping brush, a mopping roller and the like used by the cleaning device for indoor and outdoor cleaning.

Figure 4:
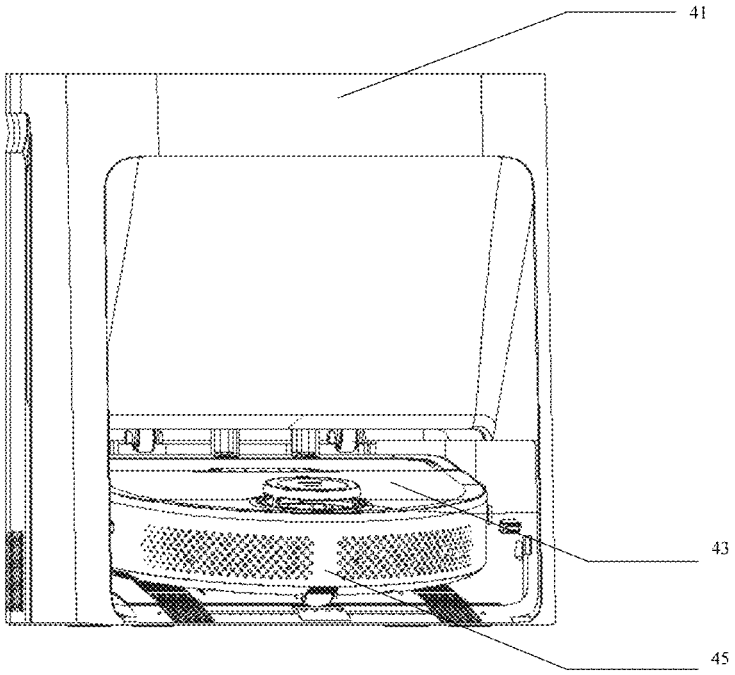
FIG. 4 is a schematic diagram illustrating a cleaning device entering a charging pile with a first posture in accordance with an exemplary embodiment of the present disclosure.

FIG. 4 is a schematic diagram illustrating a cleaning device entering a charging pile with a first posture in accordance with an exemplary embodiment of the present disclosure. As shown in FIG. 4, after a body 43 of the cleaning device enters the charging pile with the first posture from an entrance of a pile body 41 of the charging pile, the back surface 45 of the body 43 of the cleaning device is a surface facing the outer side of the entrance of the charging pile. After the cleaning device enters the charging pile with the first posture, the washing assembly on the charging pile is controlled to wash the cleaning assembly such as a sweeping brush and a mop on the cleaning device. The communication mode between the cleaning device and the charging pile may be wireless communication which specifically may be communication by an infrared communication module or data interaction through Wi-Fi.

In an exemplary embodiment of the present disclosure, after the cleaning device enters the charging pile with the first posture, the cleaning device is in a non-charging state. During cleaning of a house, the cleaning device may return to the charging pile to clean the mop once upon cleaning a region but which may only take 2 or 3 minutes. For example, after the cleaning device is set to only clean the floor, the power consumption of the cleaning device is not very high after the floor cleaning task is completed, that is, the power of the cleaning device may be 80% or more. At this time, there is no need to charge the cleaning device, but only the cleaning assembly such as the mop and sweeping brush of the cleaning device needs to be cleaned. In this way, the loss of a battery of the cleaning device can be reduced to a certain extent, and thus, the service life of the battery can be prolonged. Of course, for cleaning a carpet region, in order to avoid wetting the carpet, the cleaning device is set to only perform the cleaning mode when it enters the carpet region. According to different ground media, the cleaning device can detect the ground media through various detection modes, and is controlled by a control system to implement different cleaning strategies for different ground media based on detection results. For example, a ground medium and/or a media interface may be detected by a gyroscope, an ultrasonic sensor and a change of a current/speed of a rolling brush on the cleaning device.

In an exemplary embodiment of the present disclosure, controlling the cleaning device to enter the charging pile with the first posture includes: detecting a preset highlight pattern on the charging pile by laser forming technology on the cleaning device, or automatically navigating to the front of the charging pile according to the position of the charging pile in a preset map; based on the detected preset pattern on the charging pile, adjusting an angle of the cleaning device so as to enable the cleaning device to move into the charging pile with the first posture; in a process of the cleaning device moving into the charging pile, detecting a moving position of the cleaning device by a sensor on the body of the cleaning device, and when the cleaning device reaches a preset position, controlling a mopping roller of the cleaning device to be placed into a washing tank on the charging pile.

In an exemplary embodiment of the present disclosure, the process of controlling the washing assembly on the charging pile to perform the washing task on the cleaning assembly of the cleaning device may be implemented by a controller on the cleaning device or a controller on the charging pile.

In an exemplary embodiment of the present disclosure, in the case that the above process is implemented by the controller on the cleaning device, after the cleaning device enters the charging pile with the first posture, the controller on the cleaning device sends a washing signal to control the charging pile to clean the cleaning assembly such as the sweeping brush and the mop of the cleaning device.

In another exemplary embodiment of the present disclosure, in the case that the above process is implemented by the controller on the charging pile, after the cleaning device enters the charging pile with the first posture, the washing assembly on the charging pile is controlled to work by the controller on the charging pile so as to clean the cleaning assembly of the cleaning device.

It should be noted that all operations on controlling the charging pile or controlling the cleaning device to perform an action in the present disclosure can be implemented by the controller on the cleaning device or the controller on the charging pile, or a combination of the two controllers. The specific implementation is similar to the above operation mode. The specific control mode used in practical application is not limited in the present disclosure.

In an exemplary embodiment of the present disclosure, the cleaning device entering the charging pile with the first posture includes: detecting an indication sign on the charging pile using a sensor on the cleaning device; and controlling the cleaning device to move to a target position on the charging pile with the first posture based on the indication sign.

Specifically, before the cleaning device is controlled to enter the charging pile with the first posture, the cleaning device is controlled to move towards the charging pile with the first posture, namely, with the front surface of the cleaning device facing the charging pile. After the cleaning device locks the charging pile, the cleaning device judges the distance from the charging pile and the position of the charging pile, and starts long-distance alignment. Here, the operations of locking the position of the charging pile, judging the distance and aligning may be implemented by an infrared distance measuring sensor. The long-distance alignment may be performed in the case that the distance between the cleaning device and the charging pile is 30 cm to 50 cm.

After the alignment, the cleaning device is controlled to move to a position with a distance, such as 25 cm to 30 cm, from the front of the charging pile at a set speed, such as 10 cm/s, and then move into the charging pile at a speed, such as 20 cm/s. In the process of entering the charging pile, after a groove on a side baffle of the charging pile is identified by a wall sensor, the moving speed of the cleaning device is reduced to, such as 10 cm/s. When the mopping roller on the cleaning device is located right above the washing tank on the charging pile, the cleaning device is controlled to stop moving, and the washing assembly is started to enter a normal washing process. Of course, leading the cleaning device to move into the charging pile may also be in other forms, for example, by an LDS, infrared communication, etc., which are not specifically limited herein.

If a signal that the cleaning device fails to return to the charging pile is received, the cleaning device is controlled to retreat for a distance, such as 30 cm to 50 cm, and returns to the charging pile again at a speed, such as 20 cm/s, if connection signals received after the cleaning device returns to the charging pile are unstable for 3 to 5 times continuously, the cleaning device is controlled to shut down, a charging contact region is cleaned or an error is reported.

Specifically, after the cleaning device locks the charging pile, if it is judged that the total time for the cleaning device to return to the charging pile exceeds a preset time for returning to the charging pile, the action of the cleaning device returning to the charging pile this time is given up, and the cleaning device is controlled to move back by 30 cm. Then, the cleaning device locks the charging pile again, and performs the action of returning to the charging pile again. If the cleaning device fails to return to the charging pile for 3 to 5 times continuously, a voice broadcast is performed to remind a user of clearing an obstacle near the charging pile.

In an exemplary embodiment of the present disclosure, the sensor may be a wall sensor. The sensor can detect the groove on the side baffle of the charging pile, and then sense the change of the distance based on the groove. The indication sign may be the groove on the charging pile, and is used to indicate the position of the cleaning device on the charging pile. The target position is the position where the cleaning device is set to arrive, at which the cleaning of the cleaning device is completed.

In an exemplary embodiment of the present disclosure, controlling the washing assembly on the charging pile to perform the washing task on the cleaning assembly on the cleaning device includes: controlling the washing assembly to perform a water discharging operation to wash the cleaning assembly; controlling the cleaning device to remove water from the cleaning assembly; and controlling the washing assembly to perform a water pumping operation to pump out wastewater, wherein the wastewater is generated after the cleaning assembly is washed.

Specifically, the water discharging operation refers to controlling the clean water pump in the charging pile to discharge water in the clean water tank to the washing tank on the charging pile to wash the cleaning assembly on the cleaning device. Water removal refers to operations of spin-drying, squeezing for water removal with a scraper, etc., on the cleaning assembly of the cleaning device, and aims to avoid too much water in the washed cleaning assembly of the cleaning device, instead of completely drying the cleaning assembly of the cleaning device, such that water is prevented from being spilled everywhere in the process of cleaning the house. The water pumping operation refers to using a wastewater pump on the charging pile to recycle wastewater in the washing tank and wastewater in an auxiliary water tank to the wastewater tank. The above washing tank is an accommodating cavity for washing a mopping part of the cleaning device, and the auxiliary water tank is an accommodating cavity parallel with the washing tank for receiving water spilled out of the mopping part in the process of cleaning and spin-drying, and can prevent water from flowing to the ground along an inclined surface at the bottom of the charging pile.

In an exemplary embodiment of the present disclosure, the clean water pump on the charging pile is controlled to inject water from the clean water tank into the washing tank to wash the cleaning assembly of the cleaning device; the cleaning assembly upon cleaning is spin-dried; and the wastewater pump on the charging pile is used to recycle the wastewater in the washing tank and the auxiliary water tank into the wastewater tank.

In another exemplary embodiment of the present disclosure, before the washing assembly is controlled to perform the water discharging operation, the charging pile is controlled to perform a water injection operation on the clean water tank; a water level of the clean water tank is monitored by a water level monitoring module; and when it is monitored that the water level of the clean water tank reaches a preset water level, the charging pile is controlled to stop the water injection operation. Here, the water level monitoring module may be a water level sensor; and when it is monitored that the water level of the clean water tank reaches the preset water level of the clean water tank, the injection of water into the clean water tank is stopped.

In another exemplary embodiment of the present disclosure, after the cleaning device enters the charging pile and reaches the target position, the clean water tank is controlled to discharge water to wash the cleaning assembly on the cleaning device. In the process of discharging water, the mopping roller on the cleaning device may be controlled to rotate at a set speed, such as 60 rpm/min (60 revolutions per minute), wetting the mopping roller. After the washing tank on the charging pile is filled with water, the clean water tank is controlled to stop discharging water, and the mopping roller is controlled to enter an automatic washing process.

The automatic washing process may be set as follows: the mopping roller is set to rotate in the washing tank at a set speed, such as 350 rpm/min (350 revolutions per minute), or rotate clockwise for a certain duration such as 15 s and then counterclockwise for a certain duration such as 15 s, and the duration of the automatic washing flow may be set, for example, 30 s. After washing, the wastewater in the washing tank is pumped out.

In another exemplary embodiment of the present disclosure, the washing assembly includes a clean water tank, a washing tank and a water level monitoring module. Controlling the washing assembly to perform the water discharging operation includes: controlling the clean water tank in the washing assembly to perform the water discharging operation to inject water into the washing tank; monitoring a water level of the washing tank by the water level monitoring module; and stopping the water discharging operation when it is monitored that the water level of the washing tank reaches a preset water level.

Figure 5:
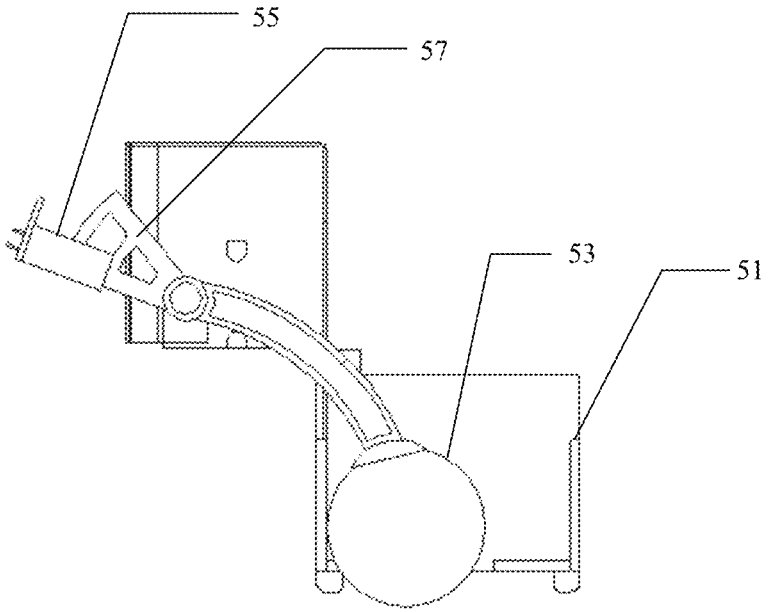
FIG. 5 is a schematic diagram illustrating water level monitoring of a washing tank in accordance with the present disclosure.
Figure 6:
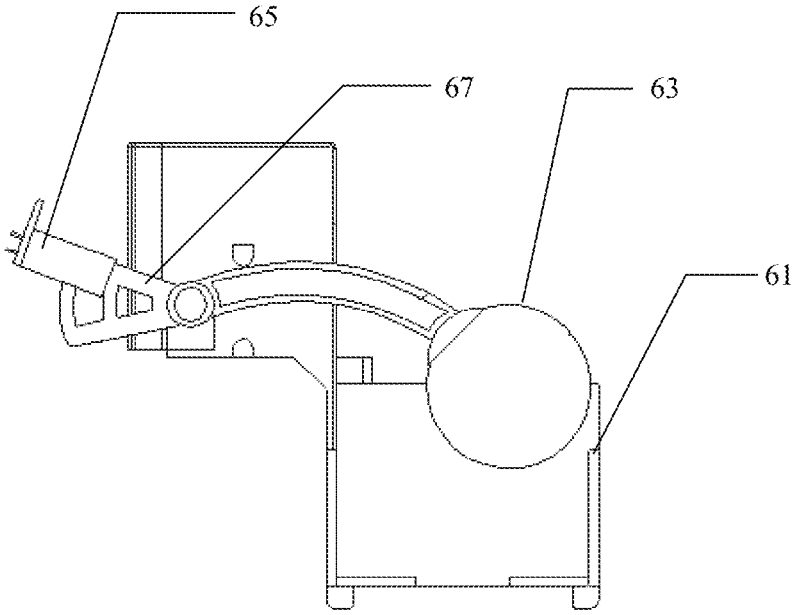
FIG. 6 is a schematic diagram illustrating water level monitoring of the washing tank in accordance with the present disclosure.

Specifically, judging whether the washing tank on the charging pile is filled with water may be implemented by a floating ball and a light interruption sensor. FIG. 5 is a schematic diagram illustrating water level monitoring of a washing tank in accordance with the present disclosure. As shown in FIG. 5, when there is no water in the washing tank 51, the floating ball 53 is in a natural drooping state, and a light signal in the light interruption sensor 55 is interrupted by a rocker 57 at the end of the floating ball 53. FIG. 6 is a schematic diagram illustrating water level monitoring of the washing tank in accordance with the present disclosure. As shown in FIG. 6, after water is injected into a washing tank 61, a floating ball 63 starts to float upward. At this time, a rocker 67 at the end of the floating ball 63 moves down, and a light signal in the light interruption sensor 65 is not interrupted, thus keeping the water injection state. When the floating ball 63 rises to a preset position, the rocker 67 at the end of the floating ball interrupts the light signal in the light interruption sensor 65 again, indicating that the washing tank 61 is filled with the water.

Specifically, the water surface may fluctuate in the process of water injection, and the rocker at the end of the floating ball may interrupt the light signal in the light interruption sensor before an actual water level of the washing tank reaches a target water level as the floating ball shakes up and down due to the fluctuating water surface, causing a problem that the water injection is stopped in advance. This problem may be solved by setting a time interval, for example, 0.1 s. In the case that the light interruption time exceeds 0.1 s, the injection of the water into the washing tank is stopped.

In an exemplary embodiment of the present disclosure, controlling the cleaning device to remove water from the cleaning assembly includes: controlling the cleaning assembly to rise to a preset height so to be isolated from the washing assembly; and controlling the cleaning assembly to rotate at a preset rotation speed for water removal. Specifically, the mopping roller of the cleaning device is controlled to rotate at a speed, for example, 1100 rpm/min (1,100 revolutions per minute), and meanwhile, water in the mopping roller may be removed by a scraper. Of course, after the wastewater in the washing tank is discharged, the cleaning assembly may be directly controlled to rotate with the scraper for a certain duration in an interfering manner, and then is lifted for spin-drying at a higher speed.

In another exemplary embodiment of the present disclosure, the washing assembly is controlled to perform the water pumping operation to pump out the wastewater includes: pumping out the wastewater and storing the wastewater into the wastewater tank.

In another exemplary embodiment of the present disclosure, after the cleaning task is completed, the clean water tank in the washing assembly may also be controlled to perform the water discharging operation to rinse the washing tank. After completing the washing task for the cleaning device, the washing tank may be self-cleaned. Specifically, the water may be injected into the washing tank through the clean water tank, and stains on the bottom wall and side walls of the washing tank are rinsed by the water flow. Then, the wastewater generated by self-cleaning of the washing tank is pumped out and stored in the wastewater tank. Meanwhile, a water outlet may also be arranged in a wastewater slot at the end of the washing tank, and can discharge liquid at a high speed to form a swirling flow in the wastewater slot. The way of rinsing and pumping out the wastewater may be pumping out the wastewater while rinsing, or pumping out the wastewater after rinsing for a time period. The specific self-cleaning of the washing tank is not limited in the present disclosure. Through the self-cleaning of the washing tank, the automation degree of the cleaning of the cleaning device can be further improved, so that manual operations can be reduced, thereby improving the comfort level of the cleaning device in use.

In S14, if the washing task is the last washing task of a cleaning process, then, after the washing task is completed and the water removal is performed, the cleaning device is controlled to exit from the charging pile, and the cleaning device is controlled to enter the charging pile with a second posture which is different from the first posture.

In an exemplary embodiment of the present disclosure, if the washing task is not the last washing task of the cleaning process, then, after the washing task is completed, the cleaning device is controlled to perform the next house cleaning task.

Here, the washing task refers to a process of washing the cleaning assembly of the cleaning device by the washing assembly on the charging pile. The cleaning process refers to a process that the cleaning device completely cleans a preset region. For example, if the cleaning device is designated to clean a living room this time, then, the above cleaning process is a process that the cleaning device completely cleans the whole living room; and if the cleaning device is designated to clean the whole room, then, the above cleaning process is a process that the cleaning device completely cleans the whole room.

The last washing task refers to washing of the cleaning assembly of the cleaning device for the last time in a cleaning process. That is, after this cleaning, the cleaning device will no longer clean the room. The next house cleaning task refers to a task of continuing to clean a region that has not been cleaned by the cleaning device in the cleaning process, if it is not the last time to wash the cleaning assembly of the cleaning device, it means that the cleaning process has not been completed. That is, there are some designated regions that have not been cleaned. Then, after washing the cleaning assembly of the cleaning device, the cleaning device is controlled to continue to perform the next house cleaning task, namely, continuing to clean the regions that have not been cleaned.

In an exemplary embodiment of the present disclosure, if the washing task is the last washing task of a cleaning process, then, after the washing task is completed, the cleaning device is controlled to exit from the charging pile, and the cleaning device is controlled to enter the charging pile with the second posture. A special case of controlling the cleaning device to exit from the charging pile will be described later. Here, the content of the washing task, the cleaning process and the last washing task is the same as that in the above text; and the second posture refers to a posture in which the back surface of the cleaning device faces forward, that is, the second posture is a posture after the cleaning device in the first posture rotates by 180 degrees.

In an exemplary embodiment of the present disclosure, after the washing task is completed, the cleaning device switches to a sweeping state. During the exit of the cleaning device from the charging pile, after an odometer of a main wheel detects that the main wheel has retreated a distance, whether the cleaning device completely exits from the charging pile may be judged by a laser distance measuring sensor arranged on the cleaning device.

Figure 7:
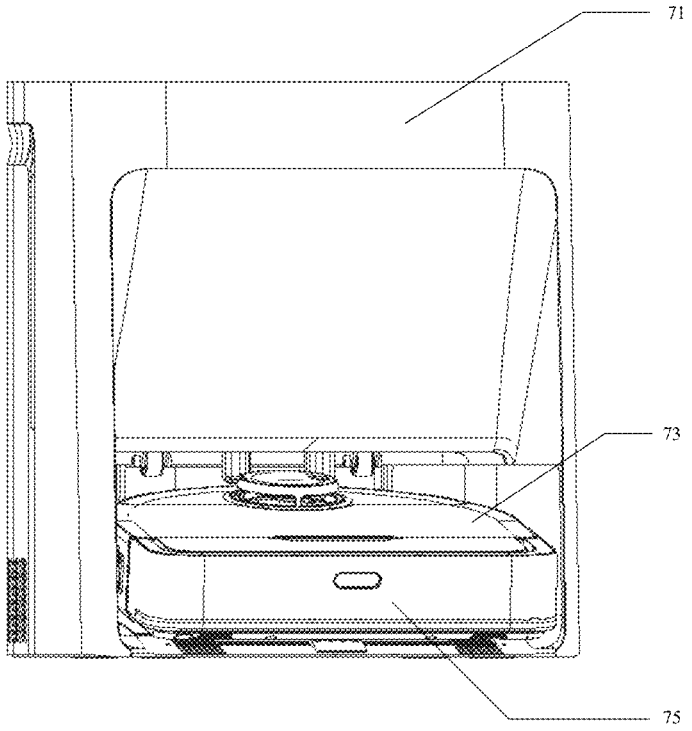
FIG. 7 is a schematic diagram illustrating the cleaning device entering a charging pile with a second posture in accordance with the present disclosure.

FIG. 7 is a schematic diagram illustrating the cleaning device entering a charging pile with a second posture in accordance with the present disclosure. As shown in FIG. 7, after a body 73 of the cleaning device enters the charging pile with the second posture from an entrance of a pile body 71 of the charging pile, the front surface 75 of the body 73 of the cleaning device is a surface facing the outer side of the entrance of the charging pile. It should be noted that the second posture may be other postures different from the first posture. That is, the posture in which the cleaning device enters the charging pile is not the posture in which the cleaning device enters the charging pile with the front surface facing forward, but the posture with a changed angle. For example, the second posture may be the posture after the front surface of the cleaning device forward rotates 30 degrees or 60 degrees to the left or right, and the cleaning device enters the charging pile with this posture. All ways of entering the charging pile with postures different from the first posture belong to the scope of the method in accordance with the present disclosure.

In an exemplary embodiment of the present disclosure, the cleaning device is controlled to move to the front surface of the charging pile with the first posture. Here, the front surface of the charging pile is a surface provided with an entrance, through which the cleaning device enters the charging pile; and when the distance between the cleaning device and the charging pile is less than a preset distance, the cleaning device is controlled to move to the front surface of the charging pile with the second posture to enter the charging pile.

In an exemplary embodiment of the present disclosure, before the cleaning device is controlled to enter the charging pile with the second posture, the cleaning device is controlled to move to the charging pile with its front surface facing the charging pile, that is, the cleaning device moves to the charging pile with the first posture. In this process, a side brush and a main brush of the cleaning device maintain a dock-to-charge rotation speed, namely, a preset fixed rotation speed.

After the cleaning device locks the charging pile, the cleaning device judges the distance from the charging pile and the position of the charging pile, and starts long-distance alignment. Here, the operations of locking the position of the charging pile, judging the distance and aligning may be implemented by an infrared distance measuring sensor. The long-distance alignment may be performed in the case that the cleaning device is at a distance from the charging pile, for example, 30 cm to 50 cm. After the alignment, the cleaning device is controlled to move to a position with a distance of, such as 25 cm to 30 cm, from the front of the charging pile at a set speed, such as 10 cm/s, for 180 degree turning around, so that the back surface of the cleaning device faces the charging pile. After turning around, the cleaning device moves into the charging pile at a set speed, such as 20 cm/s.

In the process of entering the charging pile, after a groove on a side baffle of the charging pile is identified by a wall sensor, the moving speed of the cleaning device is reduced to, such as 10 cm's. The cleaning device is controlled to stop moving upon receiving a signal indicating that a charging elastic sheet on the charging pile is connected with charging elastic sheets on both sides of the cleaning device, and waits for a next instruction.

A charging module is started upon receiving the signal indicating that connection between the charging elastic sheet on the charging pile and the charging elastic sheets on both sides of the cleaning device is stable, so as to enter a normal charging process. If a signal indicating that the connection between the charging elastic sheet on the charging pile and the charging elastic sheets on both sides of the cleaning device is unstable, the cleaning device is controlled to advance for a distance, such as 30 cm to 50 cm, and then returns to the charging pile at a speed, such as 20 cm/s. That is, after the cleaning device is controlled to exit from the charging pile, it enters the charging pile again to enable the charging elastic sheets to be effectively connected with each other. If connection signals received after the cleaning device returns to the charging pile are unstable for 3 to 5 times continuously, the cleaning device is controlled to shut down, a charging contact region is cleaned or an error is reported.

In an exemplary embodiment of the present disclosure, if the cleaning device fails to enter the charging pile within a preset duration, the cleaning device is controlled to perform a voice error reporting operation. After the cleaning device locks the charging pile, if it is judged that the total time for the cleaning device to return to the charging pile exceeds a preset time for returning to the charging pile, the action of the cleaning device returning to the charging pile this time is given up, and the cleaning device is controlled to advance for a distance, for example, 30 cm. Then, the cleaning device locks the charging pile again, and performs the action of returning to the charging pile again. If the cleaning device fails to return to the charging pile for 3 to 5 times continuously, a voice broadcast is performed to remind a user of clearing an obstacle near the charging pile.

Figure 8:
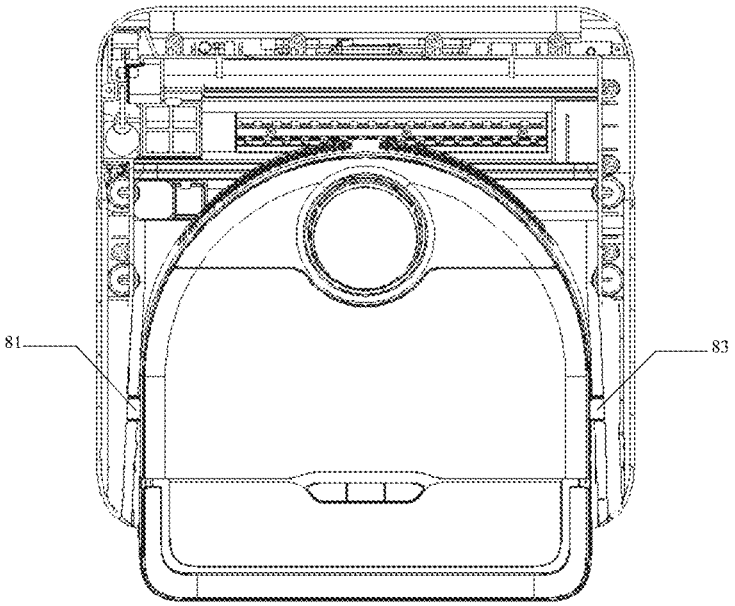
FIG. 8 is a schematic diagram illustrating the charging of the cleaning device in accordance with an exemplary embodiment of the present disclosure.

In an exemplary embodiment of the present disclosure, the charging pile includes a charging module. After the cleaning device is controlled to move to the front surface of the charging pile with the second posture to enter the charging pile, the method further includes: acquiring power information of the cleaning device; and if the power information is less than a preset power threshold, controlling the charging module to charge the cleaning device. FIG. 8 is a schematic diagram illustrating the charging of the cleaning device in accordance with an exemplary embodiment of the present disclosure. As shown in FIG. 8, after the cleaning device enters the charging pile with the second posture, the charging elastic sheet of the cleaning device is in contact with the charging elastic sheets of the charging pile, as shown in reference numerals 81 and 83 in this figure; and the cleaning device starts to be charged.

In an exemplary embodiment of the present disclosure, before the cleaning task is completed, if it is detected the power of the cleaning device is relatively low, such as lower than 10% or 20%, the cleaning device is controlled to enter the charging pile with the second posture for charging. Here, a power threshold at which the cleaning device needs to return to the charging pile for charging may be set according to an actual situation, avoiding a situation that the cleaning device cannot continue to work or return to the charging pile for charging because the power is exhausted during cleaning of a house or other places. Of course, before charging, the cleaning device may also wash the cleaning assembly, and then, enters the charging pile with the second posture for charging after the cleaning is completed, so that garbage not cleaned punctually on the cleaning assembly can be prevented from being consolidated on the cleaning assembly, thereby avoiding a subsequent difficulty in washing.

In an exemplary embodiment of the present disclosure, after the cleaning device enters the charging pile with the second posture, a value of the remaining power of the cleaning device is read. If this value is less than a preset power threshold, the charging pile is controlled to charge the cleaning device. For example, after the cleaning device completes the house cleaning task and washing, and returns to the charging pile with the second posture, the cleaning device is not charged if its remaining power is above 90%, or is charged if its remaining power is below 90%. In this way, a battery in the cleaning device can be protected, further prolonging the service life of the battery. In the charging process, the control system may further estimate and calculate the demand for the power of the cleaning device based on the saved map and a remaining area to be cleaned. When it is determined that the charging amount can ensure complete cleaning of the remaining area, the cleaning device exits from the charging pile for cleaning, thereby improving the cleaning efficiency.

In an embodiment, the user can manually set the action of the cleaning device through a mobile terminal which communicates with the cleaning device wirelessly. The mobile terminal may be a remote controller or a control program installed in a smart handheld device. Specifically, for the cleaning device, with the manual input, the mobile terminal can set, for example, a timing cleaning time, a time for returning to the pile for charging, a time for starting the device for cleaning, a time for returning to the pile for replenishing water, a time for returning to the pile for washing the cleaning assembly, and the like.

Generally, in the cleaning process of the cleaning device, the controller monitors the power of the battery on the cleaning device, and controls the cleaning device to stop cleaning and return to the charging pile for charging when the power is lower than a percentage (for example, 10%) based on a preset parameter. When the power rises to a percentage (for example, 95%), the cleaning device exits from the charging pile, and moves to the position and orientation where the previous cleaning is stopped to continue the cleaning. Of course, a controller on a more smart device can calculate a cleaned area and a remaining area to be cleaned according to the map information, calculate the approximate power required for the remaining area to be cleaned, and control the cleaning device to be charged to have the power allowing the remaining area to be cleaned to be completely cleaned and the cleaning device to return to the charging pile next time in this charging process, thereby realizing a function of intelligent breakpoint and continuous cleaning.

However, in order to meet more customization needs of different users for the cleaning device and adapt to some devices without the function of intelligent breakpoint and continuous cleaning, relevant parameters may be set through a mobile terminal. For example, a user may set a scheduled cleaning date and time through the mobile terminal. At the scheduled time, the cleaning device performs the cleaning action. Based on a first dock-to-charge remaining power set by the user, when the remaining power of the cleaning device is smaller than the above set value, the dock-to-charge action is executed; based on a first dock-to-charge charging power set by the user, when the power of the cleaning device is equal to the above set value, the cleaning device executes a power-off and continuous sweeping action, and the previous cleaning action is continued after the cleaning device moves to the position and orientation where the previous cleaning is stopped for previous dock-to-charge; based on a second dock-to-charge remaining power set by the user, when the remaining power of the cleaning device is reduced to the above set value, the cleaning device executes the dock-to-charge action again; based on a second dock-to-charge charging power set by the user, when the power of the cleaning device reaches the above set value, the cleaning device executes the power-off and continuous sweeping action again; and so on. Of course, the user may also set each dock-to-charge remaining power and each dock-to-charge charging power, or set a dock-to-charge remaining power default and a dock-to-charge charging power default in the cleaning device.

In order to prevent the battery of the cleaning device from being in a fully charged state for a long time to avoid damage to the battery, the charging control can be combined with the scheduled cleaning. The controller detects and identifies input power of a charging adapter of the cleaning device, and calculates a charging duration required by the cleaning device from the current power before returning to the charging pile to the dock-to-charge charging power set by the user. For example, if the current power is 5%, the dock-to-charge charging power set by the user is 80%, the estimated charging duration is 3 hours, and the scheduled cleaning time set by the user is AM 10:00, then, the control system controls a power source control chip to start charging at AM 7:00, and the scheduled cleaning action is started at AM 10:00. Of course, the cleaning device may also return to the charging pile to start charging immediately upon completing the cleaning task, stop charging when the power reaches the charging power set by the user, and start the cleaning task at the set scheduled cleaning time.

In addition to the scheduled cleaning and power parameters manually set by the user, when the cleaning device executes the mopping task, the scheduled mopping time, the time for returning back to the pile for washing a mop, the time for returning back to the pile for supplementing water, a water supplementation amount, and other parameters may also be manually set. For example, it is set as follows: at 10:00 AM, the cleaning device exits from the charging pile for performing scheduled mopping, returns back to the pile for washing the mop after 10 minutes, returns back to the pile for supplementing water when the water level of the water tank reduces to a scale, and executes the power-off and continuous mopping action when the water level of the water tank reaches a scale.

Figure 9:
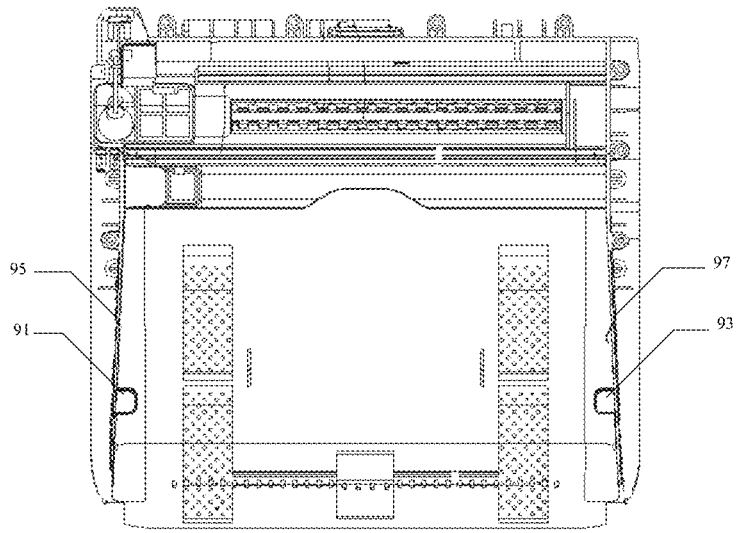
FIG. 9 is a schematic diagram illustrating a charging elastic sheet on a charging pile in accordance with an exemplary embodiment of the present disclosure.
Figure 10:
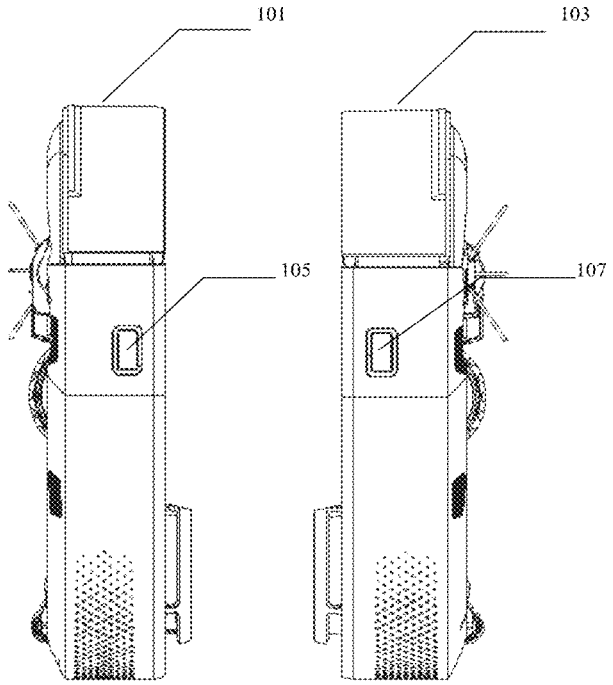
FIG. 10 is a schematic side view of the cleaning device in accordance with an exemplary embodiment of the present disclosure.

In an exemplary embodiment of the present disclosure, referring to FIG. 9. FIG. 9 is a, schematic diagram illustrating a charging elastic sheet on a charging pile in accordance with an exemplary embodiment of the present disclosure. As shown in FIG. 9, a charging elastic sheet 91 and a charging elastic sheet 93 of the charging pile are disposed on a left side edge baffle 95 and a right side edge baffle 97 of the charging pile, respectively. Referring to FIG. 10, FIG. 10 is a schematic side view of the cleaning device in accordance with an exemplary embodiment of the present disclosure. As shown in FIG. 10, a left side 101 and a right side 103 of the cleaning device are side views of both sides of the cleaning device, respectively. In the cleaning device, a, charging elastic sheet 105 is mounted on the left side 101, and a charging elastic sheet 107 is mounted on the right side 103. A magnet is additionally mounted onto each of the charging elastic sheet 91 and the charging elastic sheet 93 of the charging pile shown in FIG. 9, and magnetic conductive hardware is additionally mounted behind each of the charging elastic sheet 105 and the charging elastic sheet 107 on both sides of the cleaning device.

In an exemplary embodiment of the present disclosure, after the cleaning device enters the charging pile with the second posture and the charging elastic sheets of the charging pile and the charging elastic sheets of the cleaning device approach, the magnets attract the magnetic conductive hardware, and the charging elastic sheets on the two sides of the cleaning device are in contact with the charging elastic sheets on the two side edge baffles of the charging pile, so that the charging pile is controlled to charge the cleaning device. By this method, when charging is not carried out, the charging elastic sheets on the charging pile are closely attached to the magnets, so that friction is avoided when the cleaning device enters and exits from the charging pile, and wastewater can be prevented from splashing on the charging elastic sheets when the cleaning assembly of the cleaning device is cleaned. Thus, the charging method in the present disclosure can prevent the charging elastic sheets from being dirty and electrically corroded, preventing the two side surfaces of the appearance of the main machine from being scratched. With the magnets, the contact forces between the charging elastic sheets on the charging pile and the charging elastic sheets on the two sides of the cleaning device are increased, enabling the cleaning device to be charged normally.

Understandably, the above arrangement aims to allow the charging elastic sheets to be distal from the washing tank as much as possible, so as to avoid the pollution and damage of the wastewater generated after cleaning to the charging elastic sheets. In some embodiments, the charging elastic sheets may be arranged on the cleaning device and the charging pile in other reasonable ways, and necessary sealing measures are required to achieve the same or similar technical effects, which are not specifically limited herein.

In an exemplary embodiment of the present disclosure, after controlling the cleaning device to enter the charging pile with the second posture, the method further includes: controlling the charging pile to start an air exhaust module to dry the cleaning assembly. A fan is located at the bottom of the charging pile and under the cleaning device; an air outlet is located in the front of the charging pile and aligned with the mopping roller of the cleaning device in the charging state; and when the cleaning device is in the charging state, the charging pile is controlled to start the fan to blow-dry the mopping roller of the cleaning device. When the cleaning device is not in the charging state, the charging pile may also be controlled to start the fan to blow-dry the mopping roller of the cleaning device. For example, after the cleaning device enters the charging pile with the second posture, the fan is started to blow-dry the mopping roller of the cleaning device, in this process, there is no need to consider whether the cleaning device is in the charging state or not.

Further, an embodiment of the present disclosure provides a washing control apparatus for a cleaning assembly of a cleaning device.

Figure 11:
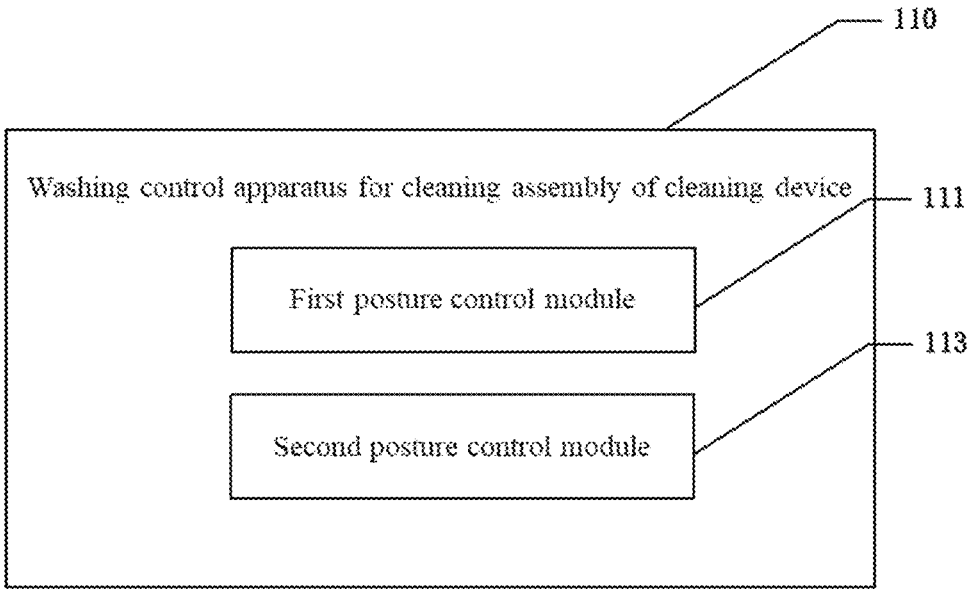
FIG. 11 is a schematic block diagram illustrating a washing control apparatus for a cleaning assembly of a cleaning device in accordance with an exemplary embodiment of the present disclosure.

FIG. 11 is a schematic block diagram illustrating a washing control apparatus for a cleaning assembly of a cleaning device in accordance with an exemplary embodiment of the present disclosure. Referring to FIG. 11, the washing control apparatus 110 for a cleaning assembly of a cleaning device in accordance with an exemplary embodiment of the present disclosure may include: a first posture control module 111 and a second posture control module 113.

In particular, the first posture control module 111 may be configured to: after the cleaning device enters a charging pile with a first posture, control a washing assembly on the charging pile to perform a washing task on the cleaning assembly of the cleaning device. The second posture control module 113 may be configured to: if the washing task is the last washing task of a cleaning process, then, after the washing task is completed, control the cleaning device to exit from the charging pile, and control the cleaning device to enter the charging pile with a second posture which is different from the first posture.

In an exemplary embodiment of the present disclosure, the first posture control module 111 may be configured to: detect an indication sign on the charging pile using a sensor on the cleaning device, the indication sign being used to indicate a position of the cleaning device on the charging pile; and control the cleaning device to move to a target position on the charging pile with the first posture based on the indication sign.

In an exemplary embodiment of the present disclosure, the first posture control module 111 may be configured to: control the washing assembly to perform a water discharging operation to wash the cleaning assembly; control the cleaning device to remove water from the cleaning assembly; and control the washing assembly to perform a water pumping operation to pump out wastewater, wherein the wastewater is generated after the cleaning assembly is washed.

In an exemplary embodiment of the present disclosure, the first posture control module 111 may be configured to: control a clean water tank in the washing assembly to perform the water discharging operation to inject water into a washing tank; monitor a water level of the washing tank by a water level monitoring module; and stop the water discharging operation when it is monitored that the water level of the washing tank reaches a preset water level.

In an exemplary embodiment of the present disclosure, the first posture control module 111 may be configured to: control the cleaning assembly to rise to a preset height so to be isolated from the washing assembly, and control the cleaning assembly to rotate at a preset rotation speed for water removal; or control the cleaning assembly to rotate for water scraping after the wastewater is pumped out, and then rise the cleaning assembly to be separated from the washing assembly for spin-drying.

In an exemplary embodiment of the present disclosure, the first posture control module 111 may be configured to control the washing assembly to pump out the wastewater and store the wastewater in a wastewater tank.

In an exemplary embodiment of the present disclosure, the first posture control module 111 may be configured to: control the clean water tank in the washing assembly to perform the water discharging operation to rinse the washing tank.

In an exemplary embodiment of the present disclosure, the first posture control module 111 may be configured to: if the washing task is not the last washing task of a cleaning process, then, after the washing task is completed, control the cleaning device to perform a next house cleaning task.

In an exemplary embodiment of the present disclosure, the second posture control module 113 may be configured to: control the cleaning device to move to the front surface of the charging pile with the first posture, wherein the front surface of the charging pile is a surface provided with an entrance, through which the cleaning device enters the charging pile; and when the distance between the cleaning device and the charging pile is less than a preset distance, control the cleaning device to move to the front surface of the charging pile with the second posture to enter the charging pile.

In an exemplary embodiment of the present disclosure, the second posture control module 113 may be configured to control the cleaning device to perform a voice error reporting operation if the cleaning device does not enter the charging pile within a preset duration.

In an exemplary embodiment of the present disclosure, the second posture control module 113 may be configured to: acquire power information of the cleaning device; and if the power information is less than a preset power threshold, control the charging module to charge the cleaning device.

In an exemplary embodiment of the present disclosure, the second posture control module 113 may be configured to control an air exhaust module to dry the cleaning assembly.

In an exemplary embodiment of the present disclosure, there is further provided a computer-readable storage medium having stored thereon a program product capable of implementing the above-described method of the present Description. In some possible embodiments, aspects of the present disclosure may also be implemented in the form of a program product including program codes which, when the program product runs on a terminal apparatus, cause the terminal apparatus to execute the steps according to various exemplary embodiments of the present disclosure described in the above "Exemplary Method" section of the present Description.

A program product for implementing the above method according to an embodiment of the present disclosure may be in form of a portable compact disk read-only memory (CD-ROM) and include program codes, and may run on a terminal apparatus such as a personal computer. However, the program product of the present disclosure is not limited thereto, and in this document, the readable storage medium may be any tangible medium which contains or stores a program, and the program may be used by or in combination with an instruction execution system, means, or a device.

The program product may be any combination of one or more readable media. The readable medium may be a readable signal medium or a readable storage medium. The readable storage medium may be, for example, but not limited to, an electrical, magnetic, optical, electromagnetic, infrared, or semiconductor system, means or device, or any combination of the above. More specific examples (a non-exhaustive list) of the readable storage medium may include: an electrical connection with one or more wires, a portable disk, a hard disk, a random-access memory (RAM), a read-only memory (ROM), an erasable programmable read-only memory (EPROM or a flash memory), an optical disk, a portable compact disk read-only memory (CD-ROM), an optical storage device, a magnetic storage device, or any suitable combination of the above.

The computer-readable signal medium may include a data signal propagated in a baseband or as part of a carrier wave, and readable program codes are carried in the data signal. This propagated data signal may be in many forms, including but not limited to an electromagnetic signal, an optical signal, or any suitable combination of the above. The readable signal medium may also be any readable medium other than the readable storage medium, and the readable medium may send, propagate, or transmit the program for use by or in combination with an instruction execution system, means, or device.

The program codes contained on the readable medium may be transmitted by any suitable medium, including, but not limited to: wireless, wired lines, optical cables, RF, etc., or any suitable combination of the above.

The program codes for executing the operations of the present disclosure may be written in one programming language or any combination of a plurality of programming languages. The above programming languages include object-oriented programming languages, such as Java and C++, and also include conventional procedural programming languages, such as "C" language or similar programming languages. The program codes may execute entirely on a user computing apparatus, partly on the user computing apparatus, as an independent software package, partly on the user computing apparatus and partly on a remote computing apparatus, or entirely on the remote computing apparatus or a server. In the case of the remote computing apparatus, the remote computing apparatus may be connected to the user computing apparatus through any type of network, including the local area network (LAN) or wide area network (WAN), or may be connected to an external computing apparatus (for example, via the Internet using an internet service provider (ISP)).

In an exemplary embodiment of the present disclosure, there is further provided an electronic device capable of implementing the above method.

It will be appreciated by those skilled in the art that various aspects of the present disclosure may be implemented as a system, a method or a program product. Therefore, various aspects of the present disclosure may be embodied in the following forms: an entirely hardware embodiment, an entirely software embodiment (including firmware, microcodes, etc.), or an embodiment combining hardware and software aspects, which may be collectively referred to herein as "a circuit", "a module" or "a system".

An electronic device 1200 according to this embodiment of the present disclosure is described below with reference to FIG. 12. The electronic device 1200 shown in FIG. 12 is only an example, and should not impose any limitation on the function and scope of use of the embodiment of the present disclosure.

Figure 12:
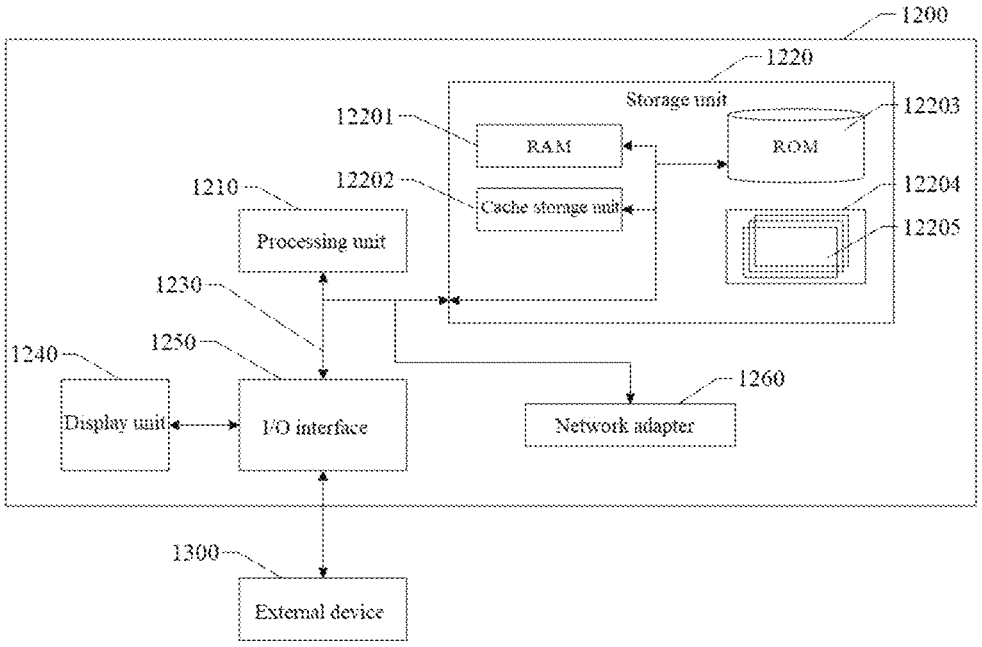
FIG. 12 is a schematic block diagram illustrating an electronic device in accordance with an exemplary embodiment of the present disclosure.

As shown in FIG. 12, the electronic device 1200 takes the form of a general-purpose computing apparatus. Components of the electronic device 1200 may include, but are not limited to: at least one processing unit 1210, at least one storage unit 1220, a bus 1230 connecting different system components (including the storage unit 1220 and the processing unit 1210), and a display unit 1240.

The storage unit 1220 may include a readable medium in the form of a volatile storage unit, such as a random-access storage unit (RAM) 12201 and/or a cache storage unit 12202, and may further include a read-only storage unit (ROM) 12203.

The storage unit 1220 may also include a program/utility 12204 having a set (at least one) of program modules 12205 including, but not limited to, an operating system, one or more applications, other program modules, and program data. Each of the operating system, one or more applications, other program modules, and program data or some combination thereof, may include an implementation of a network environment.

The bus 1230 may represent one or more of several types of bus structures, including a memory unit bus or a memory unit controller, a peripheral bus, an accelerated graphics port, a processing unit or a local bus using any of a variety of bus structures.

The electronic device 1200 may also communicate with one or more external apparatuses 1300 (e.g., a keyboard, a pointing apparatus, a Bluetooth apparatus, etc.), and may also communicate with one or more apparatuses that enable a user to interact with the electronic device 1200, and/or may also communicate with any apparatus (e.g., a router, a modem, etc.) that enables the electronic device 1200 to communicate with one or more other computing apparatuses. Such communication may occur via an input/output (I/O) interface 1250. Also, the electronic device 1200 may also communicate with one or more networks (e.g., a local area network (LAN), a wide area network (WAN), and/or a public network such as the Internet) via a network adapter 1260. As shown in the figure, the network adapter 1260 communicates with other modules of the electronic device 1200 via the bus 1230. It should be understood that, although not shown in the figure, other hardware and/or software modules may be used in conjunction with the electronic device 1200, include but are not limited to: a microcode, a device driver, a redundant processing unit, an external disk drive array, an RAID system, a tape drive and a data backup storage system, etc.

According to an embodiment of the present disclosure, a control method for a cleaning system is further provided. The cleaning system includes a cleaning device and a charging pile. As an example, in such a cleaning system, the cleaning device may be the cleaning device as described in any one of the above embodiments, and the charging pile may be the charging pile as described in any one of the above embodiments. Thus, it is readily conceivable for those skilled in the art that the specific setting of the cleaning device and/or charging pile in any one of the above embodiments may be equivalently applied to the corresponding cleaning device and/or charging pile in the cleaning system to be described below. Of course, it should also be indicated that in other embodiments of the present disclosure, the cleaning device and the charging pile in the cleaning system may also be different from those in the previous embodiments.

Figure 13:
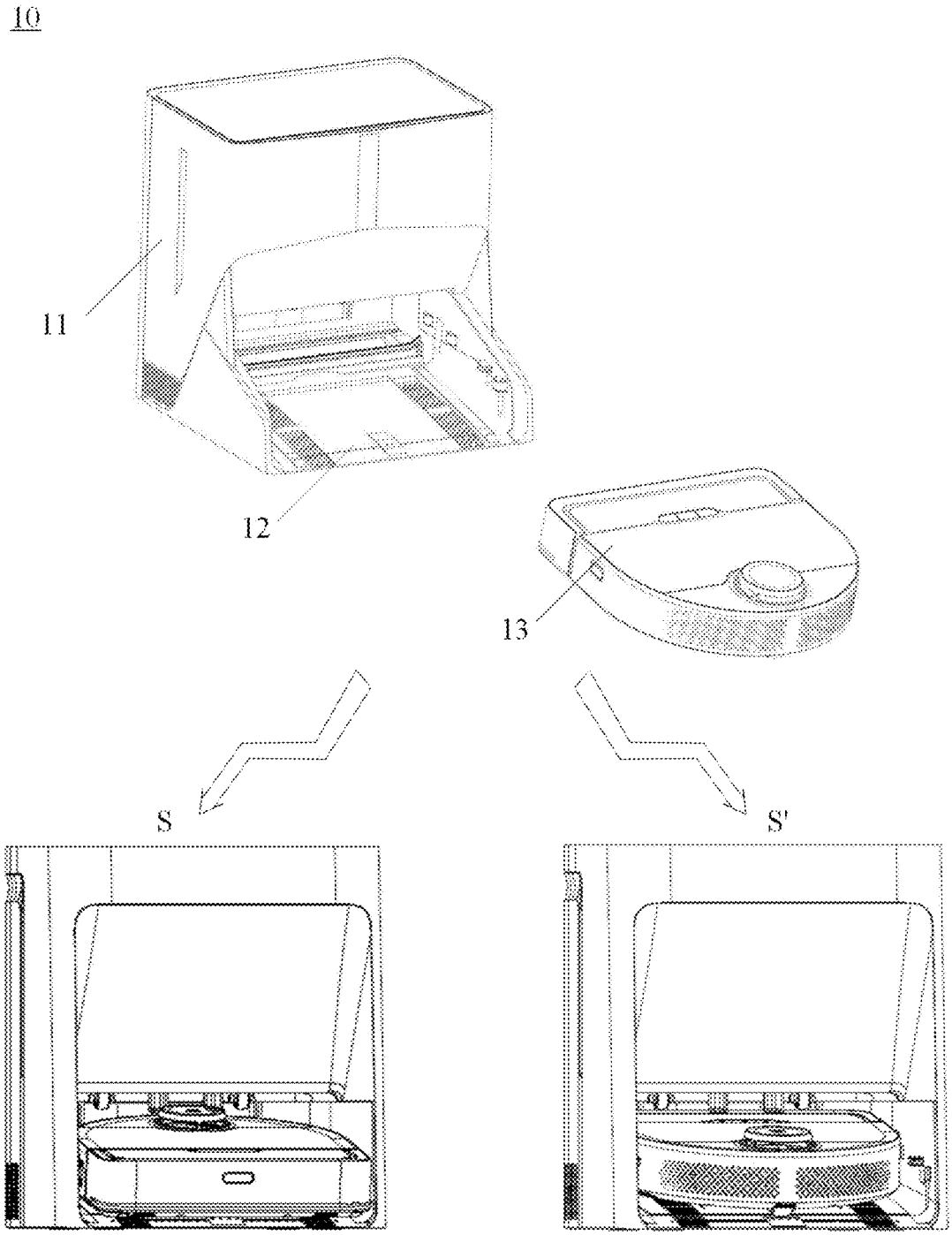
FIG. 13 is a schematic diagram illustrating an application scenario of a cleaning system in accordance with an embodiment of the present disclosure.

FIG. 13 is a schematic diagram illustrating an application scenario of a cleaning system in accordance with an embodiment of the present disclosure. As shown in FIG. 13, the cleaning system 10 includes a charging pile 11 and a cleaning device 13, and the cleaning device 13 can move into or leave the charging pile 11 along an inclined track 12 arranged on the charging pile 11. After leaving the charging pile 11 along the track 12, the cleaning device 13 can clean the floor in a designated region (for example, indoors). After moving into the charging pile 11 along the track 12, the cleaning device 13 is charged or maintained (such as dust collection) at the charging pile 11. As shown in FIG. 13, a state S in which the cleaning device 13 is charged on the charging pile 11 and a state S' in which the cleaning device 13 is maintained on the charging pile 11 are respectively shown. The above process may be automatically carried out without manual intervention. The embodiment of the present disclosure provides a control method for the above process to deal with some special situations, so that the cleaning system 10 can be more reliable and intelligent.

It is easy to understand that in the example shown in FIG. 13, the cleaning system 10 is shown as a sweeping robot, but the control method for the cleaning system in accordance with the embodiment of the present disclosure may also be applied to any other cleaning system.

Figure 14:
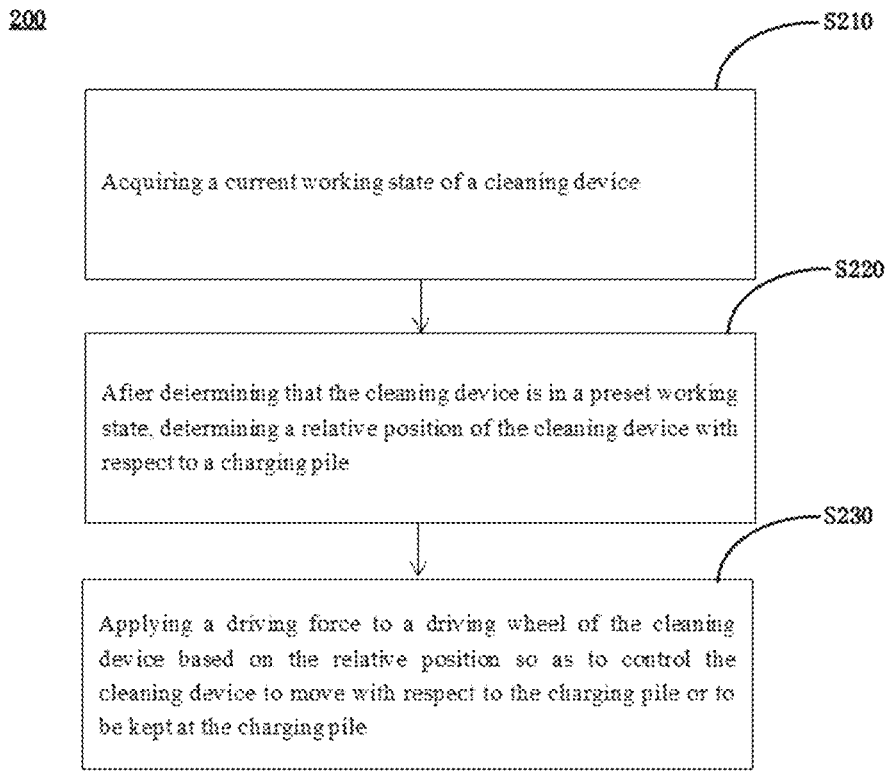
FIG. 14 is a flowchart of a control method tier a cleaning system in accordance with an embodiment of the present disclosure.

FIG. 14 is a flowchart of a control method 200 for a cleaning system in accordance with an embodiment of the present disclosure. As shown in FIG. 14, the control method 200 for the cleaning system includes the following steps.

In step S210, a current working state of a cleaning device is acquired.

In step S220, a relative position of the cleaning device with respect to a charging pile is determined after it is determined that the cleaning device is in a preset working state.

In step S230, a driving force is applied to a driving wheel of the cleaning device based on the relative position, so as to control the cleaning device to move relative to the charging pile or keep on the charging pile.

Specifically, in step S210, the current working state of the cleaning device is acquired. According to the embodiment, it is determined that the cleaning device is in the preset working state if the cleaning device is in at least one of the following working states: collecting garbage in a dust box of the cleaning device into a dust collecting chamber of the charging pile, or cleaning a cleaning assembly of the cleaning device by a washing assembly on the charging pile, or charging the cleaning device by the charging pile.

The cleaning system can use the charging pile cooperating therewith to wash a mopping roller mounted on the cleaning device. In a process of washing the mopping roller, the mopping roller is required to rotate at a high speed and interfere with a raised structure on the charging pile to achieve a cleaning effect. However, during the rotation of the mopping roller at the high speed for cleaning, due to the vibration of the cleaning device, a counter-acting force of the raised structure on the charging pile and other factors, the cleaning device will be separated from a designated position during washing, or more severely, the cleaning device may slid off the charging pile. As a result, the mopping roller can't effectively cooperate with the raised structure or a cleaning scraper on the charging pile, and the cleaning effect can't be achieved.

In step S220, if it is determined that the cleaning device is in the preset working state, the relative position of the cleaning device with respect to the charging pile is further determined, so as to acquire the degree of separation of the cleaning device from the charging pile, which facilitates a subsequent measure to be taken to keep the cleaning device stable on the charging pile during the washing and prevent the cleaning device from sliding oil the charging pile.

In step S230, the driving force is applied to the driving wheel of the cleaning device based on the relative position. In a specific embodiment, the movement of the cleaning device may be controlled according to the degree of deviation of the cleaning device from the designated position at the charging pile, such as the distance from the designated position.

According to the embodiment of the present disclosure, by controlling the movement of the cleaning device based on the current working state of the cleaning device and the relative position of the cleaning device with respect to the charging pile, the movement of the cleaning device is adjusted based on an actual special situation and emergency situation, so that more reliable and intelligent control is realized, improving the user experience.

According to the embodiment, applying the driving force to the driving wheel of the cleaning device based on the relative position may include: applying the driving force to the driving wheel of the cleaning device along the direction, in which the cleaning device moves towards the charging pile, in the case that the cleaning device moves to the designated position on the charging pile. The driving force is a force capable of counteracting a force causing the movement of the cleaning device away from the charging pile. When the cleaning device is located at the designated position, a driving force with a smaller duty ratio is continuously applied to the driving wheel of the cleaning device, enabling the driving wheel to have a tendency to move forward. However, at this time, the cleaning device cannot continue to move with respect to the charging pile since it is already located at the designated position, and this driving force can overcome the sliding of the cleaning device along an inclined parking surface of the charging pile under the action of gravity, or counteract a counter-acting force of pushing the cleaning device away from the designated position caused by cleaning or dust collection on a base station.

Further, according to the embodiment, before the cleaning device moves to the designated position on the charging pile, the driving force is applied to the driving wheel of the cleaning device at a first rate along the direction, in which the cleaning device moves towards the charging pile. In a process that the cleaning device moves into the charging pile, the driving wheel moves at the first rate which may be a normal walking rate or higher or lower than the normal walking rate.

Further, according to the embodiment, before the cleaning device moves to the designated position on the charging pile, the driving force is applied to the driving wheel of the cleaning device at a second rate along the direction, in which the cleaning device moves towards the charging pile. The second rate is a rate adjusted based on a preset algorithm.

Figure 15:
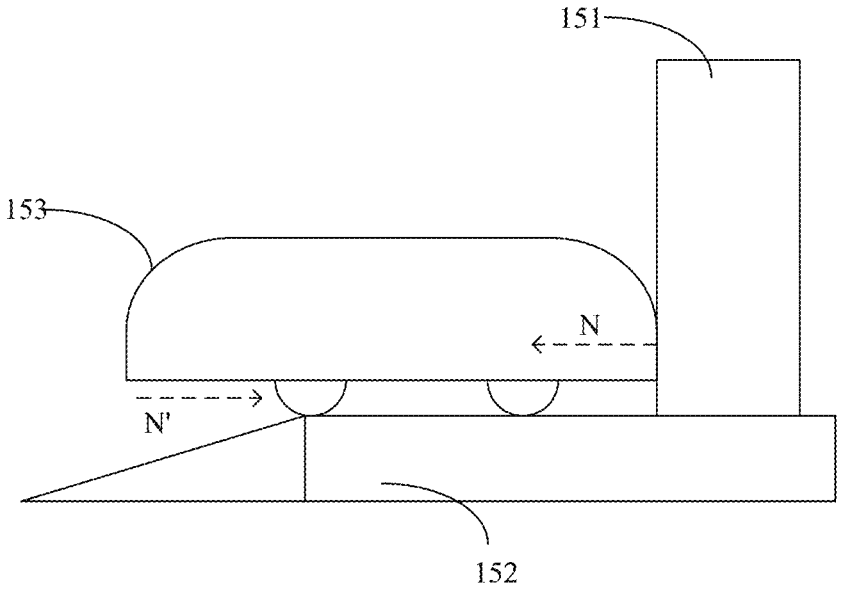
FIG. 15 is a schematic diagram of controlling the positioning of a cleaning device at a designated position on the charging pile in accordance with an embodiment of the present disclosure.

FIG. 15 is a schematic diagram of controlling of the positioning of a cleaning device at a designated position on a charging pile according to an embodiment of the present disclosure, which is explained below with reference to FIG. 15.

In this embodiment, the cleaning device may interact with the charging pile in various ways, such as collecting garbage in a dust box of the cleaning device into a large dust collecting chamber in the charging pile, or cleaning a mopping roller or mop with a mopping function on the cleaning device by using a washing assembly on the charging pile. During the interaction process, the cleaning device will be separated from the charging pile and the best interaction site due to the force. As shown in FIG. 15, the charging pile 151 has an inclined track 152, and the cleaning device 153 moves to a designated position on the charging pile 151 via the track 152. In the process of executing the above interaction, a force N may be generated, and the force N points to the direction of pushing the cleaning device 153 away from the charging pile 151. As a result, the cleaning device 153 may leave the designated position on the charging pile 31, adversely affecting the above interaction process.

In some embodiments, the movement of the cleaning device 153 may be controlled in a continuous control manner. Specifically, once the cleaning device 153 reaches the designated position on the charging pile 151, a smaller duty ratio is continuously applied to a driving motor of wheels of the cleaning device 153 until the interaction is completed, so as to eliminate the influence of the force N.

By this way, the position of the cleaning device can be kept effectively. However, the motor is driven with the smaller duty ratio continuously, but the continuous application of the smaller duty ration is not suitable except a specific working state. When the cleaning device is parked on the charging pile and not in the specific working state, the user sometimes needs to pull out the cleaning device from the charging pile. At this time, if the driving wheel still have a tendency to move forward, it brings a difficulty for the user during pulling out the cleaning device.

In some embodiments, the movement of the cleaning device 153 may be controlled in a fixed mode manner. Specifically, at the beginning of the interaction, a larger duty ratio is applied to the driving motor of the Wheels of the cleaning device 153, so that the cleaning device 153 moves to or returns to the designated position. Then, the applied duty ratio is reduced to a smaller duty ratio sufficient to eliminate the influence of the force N over time, so that the cleaning device 153 can be kept at the designated position on the charging pile 151.

In this way, since the driving motor of the cleaning device is controlled with the larger duty ratio firstly, the cleaning device can move to or return to the designated position before deviation quickly. However, due to the higher speed, the cleaning device may collide with the charging pile, causing the wear of the edge of the cleaning device, the surface of the charging pile, and the wheels of the cleaning device.

In some embodiments, the movement of the cleaning device 153 may be controlled by a feedback control manner. Specifically, firstly, two states, namely, an in-place state and an out-of-place state, are defined, and use different control modes respectively. In the in-place state, namely, a state in which the cleaning device 153 is at the designated position on the charging pile 151, when the cleaning device 153 reaches the designated position, the driving motor of the wheels of the cleaning device 153 is controlled with a smaller duty ratio sufficient to eliminate the influence of the force N. In the out-of-place state, namely, a state opposite to the above in-place state, the driving motor of the wheels of the cleaning device 153 is controlled in a manner including PIE) adjustment. In some embodiments, for a better control effect, the cleaning device 153 may be continuously controlled for a short time period (e.g., 1 s) in an out-of-place manner when it switches from the out-of-place state to the in-place state.

In a specific embodiment, a sensor may be adopted to judge whether the cleaning device 153 is in the in-place state or the out-of-place state. For example, the sensor makes a judgment based on a trigger state in which the cleaning device 153 collides with a buffer when it reaches the designated position, a pattern state fed hack by a radar sensor of the cleaning device 153, a trigger state of an in-place switch on the cleaning device 153, a flow passing state of the wheels of the cleaning device 153, a tilt angle state of a gyroscope of the cleaning device 153, a combination of the above one or more sensor states, and the like, which are not limited in the embodiment of the present disclosure.

In this way, since a speed control algorithm is adopted to control the driving motor of the cleaning device, it can not only enable the cleaning device to quickly return to the designated position before deviation, but also avoid the wear of the edge of the cleaning device and the surface of the charging pile caused by the collision between the cleaning device and the charging pile.

According to the embodiment of the present disclosure, when the cleaning device is at the designated position on the charging pile, the set smaller duty ratio is applied to the driving motor of the wheels of the cleaning device. As shown in FIG. 15, a force N' generated by driving may provide the wheels of the cleaning device with a tendency to move forward, and this tendency can counteract the possible backward movement of the cleaning device, so that the cleaning device can be reliably located at the designated position on the charging pile, thereby ensuring the interaction between the cleaning device and the charging pile.

According to the embodiment, applying the driving force to the driving wheels of the cleaning device based on the relative position may further include: in the case that the distance between the cleaning device and the designated position on the charging pile is less than or equal to a preset threshold, driving the cleaning device to move in the direction towards the charging pile until the cleaning device moves to the designated position on the charging pile, and stopping driving the cleaning device.

In other embodiments, applying the driving tierce to the driving wheels of the cleaning device based on the relative position may further include: in the case that the distance between the cleaning device and the designated position on the charging pile is larger than the preset threshold, keeping the relative position of the cleaning device with respect to the charging pile unchanged in a preset time period; and after the preset time period, determining whether a state of an apparatus related to the preset working state of the cleaning device changes, in the case that the state of the apparatus related to the preset working state of the cleaning device does not change, driving the cleaning device to move in the direction towards the charging pile until the cleaning device moves to the designated position on the charging pile, and stopping driving the cleaning device, or in the case that the state of the apparatus related to the preset working state of the cleaning device changes, keeping the relative position of the cleaning device with respect to the charging pile unchanged.

Figure 16A:
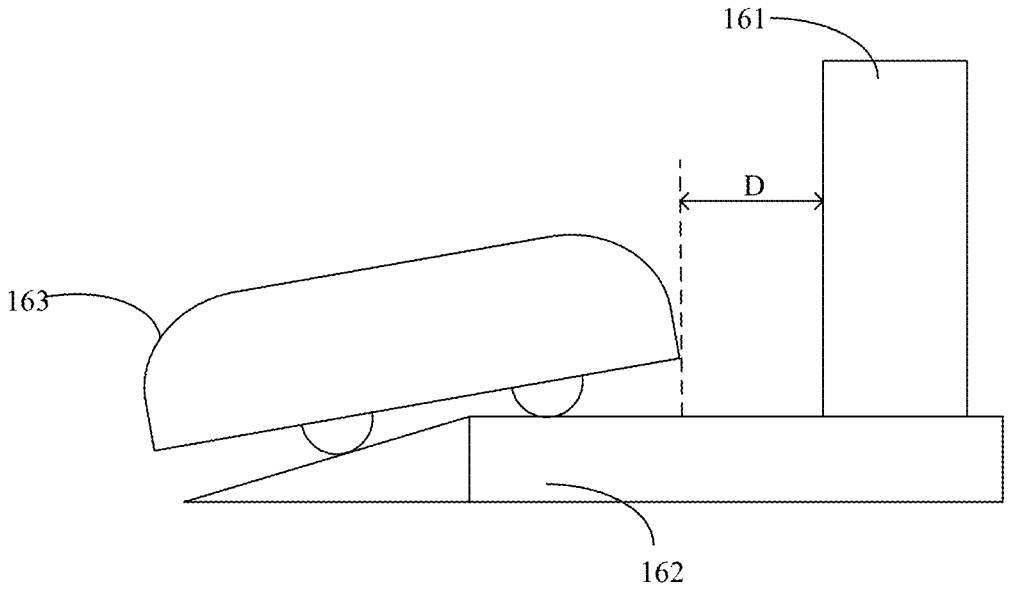
FIGS. 16A and 16B are schematic diagrams illustrating the control of the cleaning device when the cleaning device deviates from the designated position in accordance with an embodiment of the present disclosure.
Figure 16B:
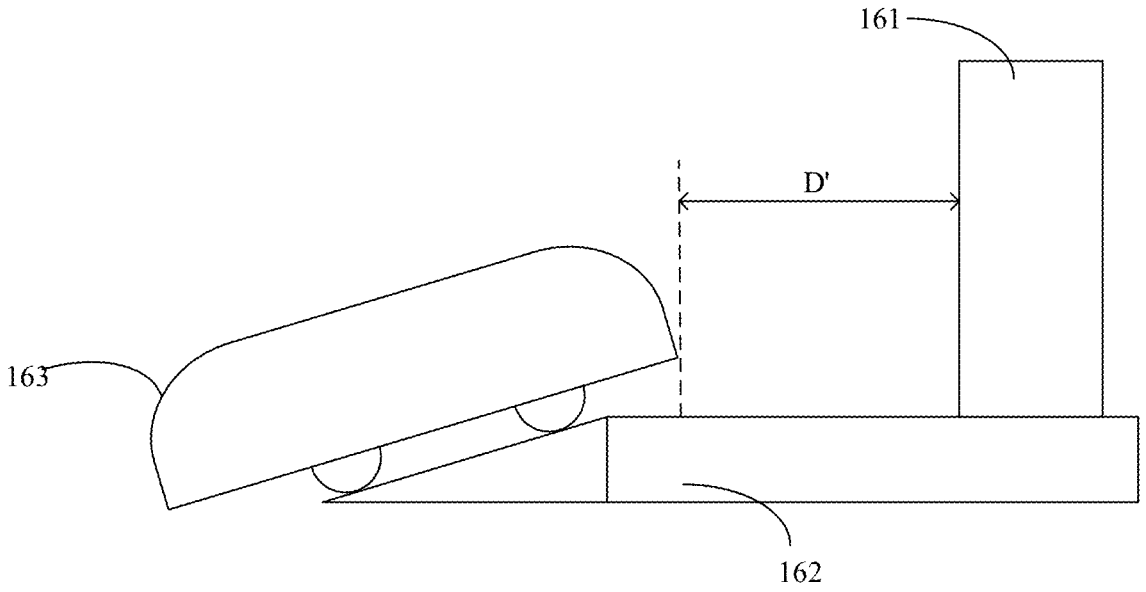

FIGS. 16A and 16B are schematic diagrams illustrating the control of the cleaning device when the cleaning device deviates from the designated position in accordance with an embodiment of the present disclosure, which is explained below with reference to FIGS. 16A and 16B.

During maintaining of the cleaning system, the user may manually drag the cleaning device away from the charging pile instead of moving it away from the charging pile for convenience. At this time, if the user does not move the charging pile oft the ground, then, the cleaning device enters returning and backrub logic, adversely affecting the operation fluency of the user.

As shown in FIGS. 16A and 16B, when the cleaning device 163 is in a power-on state, the controller of the cleaning device 163 continuously monitors a movement state of a main wheel odometer of the cleaning device 163. The main wheel odometer has a threshold, and measures an ODO value of the cleaning device 163 naturally sliding off the inclined track 162 of the charging pile 161. When the controller of the cleaning device 163 detects the change of the ODO value, the cleaning device 163 is controlled respectively according to the change of the ODO value. According to the embodiment, if the ODO value D≤the threshold, the cleaning device 163 enters first backrub logic, as shown in FIG. 16A. If the ODO value D'>the threshold, the cleaning device 163 enters second backrub logic, as shown in FIG. 16B.

In the first backrub logic, the two wheels of the cleaning device 163 rotate synchronously and reversely until the cleaning device 163 is restored to the original state (for example, the charging state or the dust collection state). In addition, in other embodiments, it is also possible to stop the rotation of a main wheel and start an electromagnetic brake according to protection when a current of the main wheel of the cleaning device 163 is too large or when the current of the main wheel of the cleaning device 163 is greater than a certain threshold.

In the second backrub logic, the cleaning device 163 stays in place for a time period, for example, several minutes. If there is no change of a state such as taking out and putting back of the dust box, triggering of a cliff sensor, triggering of a falling sensor for the main wheel, triggering of the front of the pile, or the like during the stay, the cleaning device 163 is restored to the original state (for example, the charging state or the dust collection state) upon the preset time. If the above state changes, the cleaning device 163 stays in place and does nothing.

According to the embodiment of the present disclosure, it is possible to clearly distinguish different situations in which the user actively moves the cleaning device away and the cleaning device itself deviates from the designated position, so that the cleaning device can be distinguishingly controlled according to different situations, improving the intelligence of the cleaning system and the user experience.

According to the embodiment, under the condition that it is determined that the cleaning device is in the preset working state, a movement state of the charging pile is monitored; after the movement state of the charging pile changes, the cleaning device is used for repositioning; and a pre-stored position of the charging pile is updated according to the repositioning result.

Figure 17:
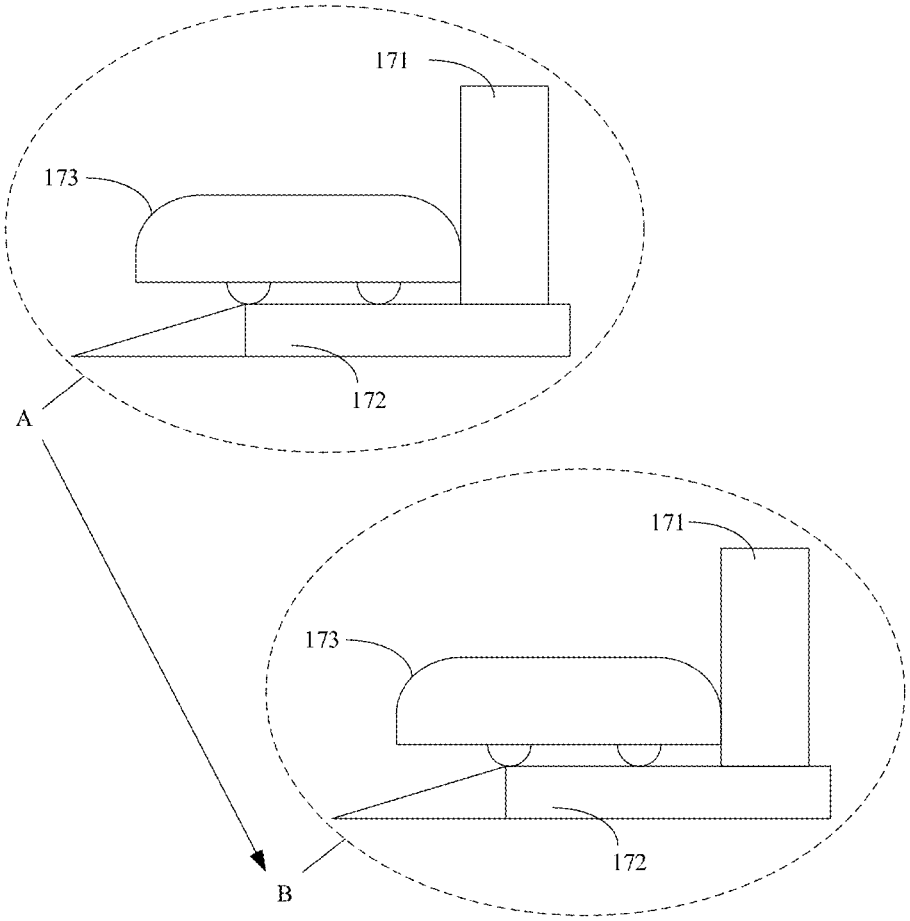
FIG. 17 is a schematic diagram illustrating the repositioning of the charging pile in accordance with an embodiment of the present disclosure.

FIG. 17 is a schematic diagram illustrating the repositioning of the charging pile in accordance with an embodiment of the present disclosure, which is explained below with reference to FIG. 17.

As shown in FIG. 17, the cleaning system has a function of "saving a map", while this function is enabled only under a precondition that the position of the charging pile 171 must be fixed. If during the charging of the cleaning device 173, the position of the charging pile 171 moves in a wide range (for example, as shown in FIG. 17, if the charging pile 171 is moved from the position A to the position B), then, the cleaning device 173 leaves the charging pile 171 via the inclined track 172 of the charging pile 171. If it is not repositioned after a longer time, there is an error in simultaneous localization and mapping (SLAM) positioning, and the cleaning device 173 cannot clean successfully. However, due to a longer repositioning time, if repositioning is carried out every time after the cleaning device leaves the charging pile, preheating time for each cleaning is lengthened, seriously affecting the user experience.

According to the embodiment, when the cleaning device 173 is located on the charging pile 171, if the cleaning device 173 finds that it has moved (actually, the cleaning device 173 has moved together with the charging pile 171), repositioning in the movement simultaneous with the pile is started.

In a specific embodiment, after the cleaning device 173 enters a preset state, the movement state of the cleaning device 173 is continuously monitored by sensors such as the gyroscope, the falling sensor, and the main wheel odometer. After any of the above sensors detects that the cleaning device 173 has changed its movement state, that is, the sensor detects that the cleaning device 173 has changed its movement state, and after the sensor detects that the cleaning device 173 stops moving, the cleaning device 173 starts to perform the repositioning in the movement simultaneous with the pile.

When the cleaning device 173 and the charging pile 171 are relatively stationary, the position of the charging pile 171 in a pre-stored map is determined by repositioning the cleaning device 173.

In a specific embodiment, the cleaning device 173 may be repositioned by an LDS and/or a camera, and the repositioning process is approximately as follows: the cleaning device 173 rotates in situ, is repositioned through the LDS and/or the camera, and moves by a distance for repositioning if the previous repositioning is unsuccessful. The repositioning is performed only depending on the positioning of the cleaning device 173 relative to an obstacle/target location stored in the map. When the cleaning device 173 is repositioned on the charging pile 171, if there is no camera or the camera does not face the outside of the charging pile 171, the repositioning can only rely on the LDS.

In a specific embodiment, after entering the logic of "repositioning in the movement simultaneous with the pile", the cleaning device 173 starts the LDS laser sensor on the charging pile 171 for repositioning on the pile. During repositioning on the pile, the LDS sensor of the cleaning device 173 will match the similarity between a current laser map and a map before the cleaning device 173 (the charging pile 171) moves. If the similarity between the maps is lower than a threshold, it is determined that the cleaning device 173 has "the movement simultaneous with the pile", Meanwhile, after the repositioning on the pile is successful, the cleaning device 53 will clear the last saved position of the charging pile 171 and re-mark a current position as the position of the charging pile 171. If the repositioning of the cleaning device 173 on the pile fails, after the cleaning device 173 leaves the charging pile 171, the cleaning device enters routine local repositioning logic. After the repositioning is successful, the last marked position of the charging pile 171 is cleared, and a current position is marked as a new position of the charging pile 171. Based on whether a charging electrode of the cleaning device is in contact with a charging electrode of the charging pile, the cleaning device can know whether it is charged by the charging pile or executes other tasks currently, of course, which may be judged by other ways, and the embodiments of the present disclosure do not limit these.

According to the embodiments of the present disclosure, the leave-pile starting cleaning experience of the cleaning device is optimized in the case that a large charging pile is adopted.

According to the embodiment, after it is determined that the cleaning device ends the preset working state and intends to leave the charging pile, the relative position of the cleaning device with respect to the charging pile is acquired; after it is determined that the relative position of the cleaning device with respect to the charging pile does not change, a driving force is applied to the driving wheel of the cleaning device at a third rate along the direction in which the cleaning device moves away from the charging pile. The third rate is greater than a rate when the cleaning device normally works.

Figure 18:
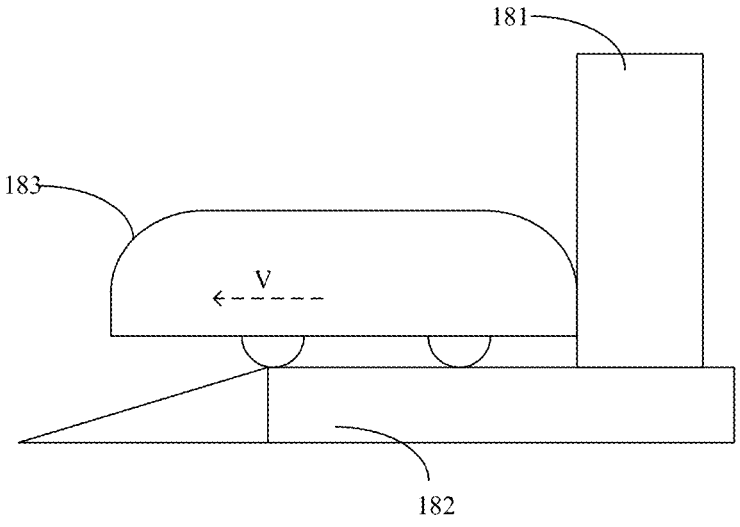
FIG. 18 is a schematic diagram illustrating the control when the cleaning device leaves the charging pile in accordance with an embodiment of the present disclosure.

FIG. 18 is a schematic diagram illustrating the control when the cleaning device leaves the charging pile in accordance with an embodiment of the present disclosure, which is explained below with reference to FIG. 18.

As shown in FIG. 18, the charging pile 181 has an inclined track 182. After the cleaning device 183 drives into the charging pile 181 via the track 182, since there is a requirement to keep the cleaning device 183 on the charging pile 181, the charging pile 181 is generally provided with wheel parking grooves or baffles to prevent the cleaning device 183 from sliding off along the track 182 of the charging pile 181.

If the cleaning device 183 completes the set work in the preset working state, for example, if the charging of the cleaning device is completed and the cleaning device intends to leave the charging pile 181 for other actions, the cleaning device moves backward or forward at first to leave the charging region according to a particular orientation of the head of the cleaning device during charging. Because of the interference among the environmental ground, the structure of the charging pile and the structure of the cleaning device, slipping of wheels or the resistance of another assembly on the cleaning device that is in contact the ground, it may lead to a phenomenon that the wheels are controlled to travel but do not move actually.

In the embodiment of the present disclosure, aiming at this phenomenon, it is first required to judge whether the cleaning device 183 has not left the charging pile 181. Specifically, first of all, using wheel rotation for counting is taken into consideration. Because of the possibility of slipping, there is no guarantee that it can be judged. Here, by comparing the LDS data before control with the data after a time period, whether the cleaning device 183 has not left the charging pile 181 can be judged, if it is judged that the cleaning device 183 has not left the charging pile 181, the cleaning device 183 is controlled to dash for a short distance with a higher speed V to reduce the probability of being stuck in the charging pile 181.

According to the embodiments of the present disclosure, the control of enabling the cleaning device to leave the charging pile quickly can be realized, and thus, the use experience of the cleaning system can be optimized.

Figure 19:
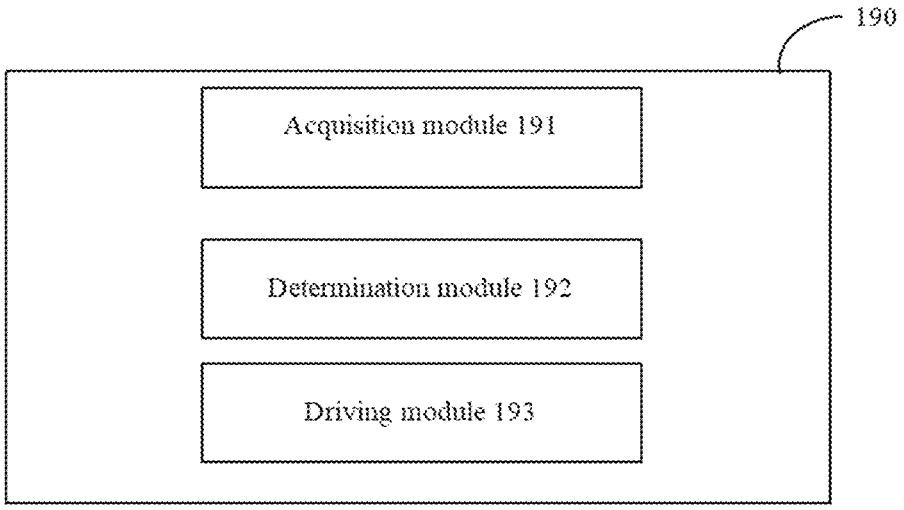
FIG. 19 is a block diagram of a control apparatus for a cleaning system in accordance with an embodiment of the present disclosure.

An embodiment of the present disclosure further provides a control apparatus for a cleaning system. FIG. 19 is a block diagram of a control apparatus 190 for a cleaning system in accordance with an embodiment of the present disclosure. The control apparatus 190 for a, cleaning system includes an acquisition module 191, a determination module 192 and a driving module 193.

According to this embodiment, the acquisition module 191 is configured to acquire a current working state of the cleaning device. The determination module 192 is configured to, after determining that the cleaning device is in a preset working state, determine a relative position of the cleaning device with respect to a charging pile. The driving module 193 is configured to apply a driving force to a driving wheel of the cleaning device based on the relative position so as to control the cleaning device to move with respect to the charging pile or to be kept at the charging pile.

Specific operations of the above functional modules can be acquired from the operation steps of the control method 200 for a cleaning system described in the foregoing embodiments, and will not be repeated herein.

Specific operations of the above functional modules can be acquired from the operation steps of the control method 200 for a cleaning system described in the foregoing embodiments, and will not be repeated herein.

Figure 20:
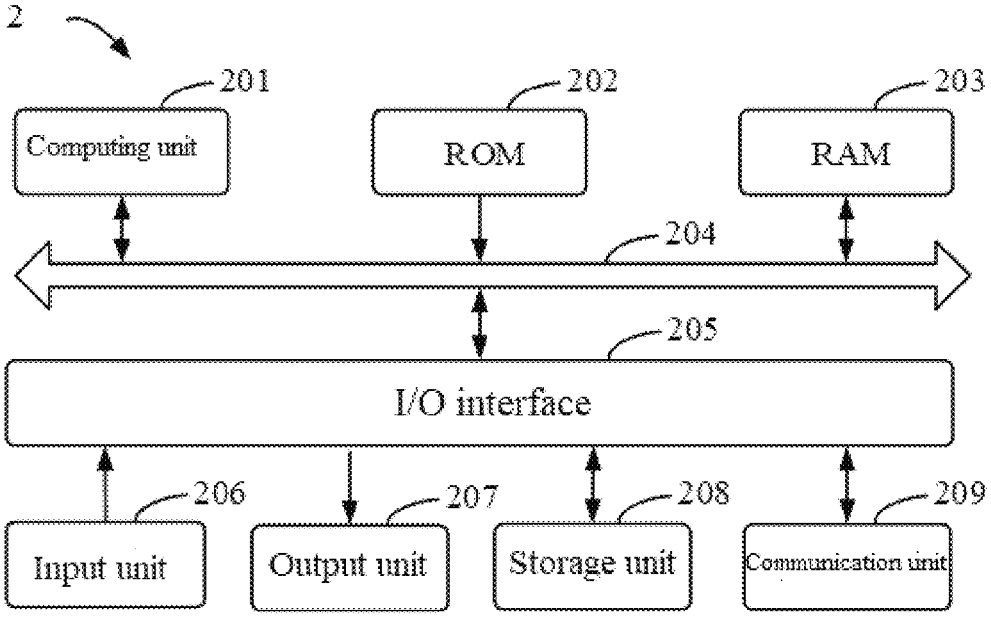
FIG. 20 is a block diagram of an electronic device for realizing the method of an embodiment of the present disclosure.

An embodiment of the present disclosure further provides an electronic device for realizing the above methods. FIG. 20 is a block diagram of an electronic device 2 for realizing the method of an embodiment of the present disclosure. The electronic device is intended to denote various digital computers, or various mobile apparatuses or other similar computing apparatuses. The components shown in the present document as well as their connection relations and their functions are only examples, and are not intended to limit the description in the present document and; or require the implementation of the present disclosure.

As shown in FIG. 20, the device 2 includes a computing unit 201 that can perform various appropriate actions and processing in accordance with a computer program stored in a read-only memory (ROM) 202 or a computer program loaded into a random-access memory (RAM) 203 from a storage unit 208. The RAM 203 can store various programs and data necessary for the operations of the device 2. The computing unit 201, the ROM 202 and the RAM 203 are connected to each other through a bus 204. An input/output (I/O) interface 205 is also connected to the bus 204.

Various components in the device 2 are connected to the I/O interface 205, including: an input unit 206, such as a keyboard, a mouse, etc., an output unit 207, such as various types of displays, speakers, etc., a storage unit 208, such as a magnetic disk, an optical disk, etc., and a communication unit 209, such as a network card, a modem, a wireless communication transceiver, etc. The communication unit 209 allows the device 2 to exchange information/data with other devices through a computer network such as the Internet and/or various telecommunication networks.

The computing unit 201 may be various general-purpose and/or special-purpose processing components with processing and computing capabilities. Some examples of the computing unit 201 include, but are not limited to, central processing units (CPUs), graphics processing units (GPUs), various special-purpose artificial intelligence (AI) computing chips, various computing units that run machine learning model algorithms, digital signal processing processors (DSPs), and any suitable processors, controllers, microcontrollers, etc. The computing unit 201 performs the various methods and processes described above.

Various implementations of the systems and techniques described herein above can be implemented in digital electronic circuitries, integrated circuit systems, field programmable gate arrays (FPGAs), application-specific integrated circuits (ASICs), application-specific standard products (ASSPs), system-on-chip systems (SOCs), load programmable logic devices (CPLDs), computer hardware, firmware, software, and/or combinations thereof. These various embodiments may be implemented in one or more computer programs. The one or more computer programs are executable and/or interpretable on a programmable system including at least one programmable processor, which may be a special-purpose or general-purpose programmable processor and which may receive data and instructions from a storage system, at least one input device and at least one output device, and transmit data and instructions to the storage system, the at least one input device, and the at least one output device.

Program codes for implementing the methods of the present disclosure may be written in any combination of one or more programming languages. These program codes may be provided to a processor or controller of a general-purpose computer, special-purpose computer or other programmable data processing apparatus, such that the program codes, when executed by the processor or controller, perform the functions/operations specified in the flowcharts and/or block diagrams. The program codes may be executed entirely or partly on a machine, or may be executed partly on the machine as an independent software package, and may be executed partly on a remote machine or may run entirely on the remote machine or server.

In the context of the present disclosure, a machine-readable medium may be a tangible medium that may contain or store a program for use by or in connection with an instruction execution system, apparatus or device. The machine-readable medium may be a machine-readable signal medium or a machine-readable storage medium. Machine-readable media may include, but are not limited to, electronic, magnetic, optical, electromagnetic, infrared, or semiconductor systems, apparatuses or devices, or any suitable combination of the foregoing. More specific examples of machine-readable storage media would include one or more wire-based electrical connections, portable computer disks, hard disks, random-access memories (RAMs), read-only memories (ROMs), erasable programmable read-only memories (EPROMs or flash memories), fiber optics, portable compact disk read only memories (CD-ROMs), optical storage devices, magnetic storage devices, or any suitable combination of the foregoing.

A computer system can include clients and servers. Clients and servers are generally remote from each other and usually interact with each other through a communication network. The relationship of a client and a server arises by computer programs running on the respective computers to establish a client-server relationship between the two.

From the description of the above embodiments, those skilled in the art can easily understand that the exemplary embodiments described herein may be implemented by software, or may be implemented by software combined with necessary hardware. Therefore, the technical solutions according to the embodiments of the present disclosure may be embodied in the form of a software product, and the software product may be stored in a non-volatile storage medium (which may be a CD-ROM, a U disk, a mobile hard disk, etc.) or on a network which includes several instructions to cause a computing device (which may be a personal computer, a server, a terminal apparatus, or a network apparatus, etc.) to execute the methods according to the embodiments of the present disclosure.

In addition, the above-mentioned figures are merely schematic illustrations of the processes included in the methods according to the exemplary embodiments of the present disclosure, and are not intended to be limiting. It is easy to understand that the processes shown in the above figures do not indicate or limit the chronological order of these processes. In addition, it is also readily understood that these processes may be performed synchronously or asynchronously, for example, in multiple modules.

It should be noted that although several modules or units of the device for action performance are mentioned in the above detailed description, this division is not mandatory. In fact, according to embodiments of the present disclosure, the features and functions of two or more modules or units described above may be embodied in one module or unit. Conversely, the features and functions of one module or unit described above may be further divided into multiple modules or units to be embodied.

This application is intended to cover any variations, uses, or adaptations of the present disclosure that follow the general principle of the present disclosure and include common knowledge or techniques in the technical field not disclosed by the present disclosure. The Description and embodiments are to be regarded as exemplary only, with the true scope and spirit of the present disclosure being indicated by the claims.

What is claimed is:

1. A washing control method for a cleaning assembly of a cleaning device, comprising:

after the cleaning device enters a charging pile with a first posture, controlling a washing assembly on the charging pile to perform a washing task on the cleaning assembly of the cleaning device; and in response to the washing task being the last washing task of a cleaning process and the washing task being completed, controlling the cleaning device to exit from the charging pile, and controlling the cleaning device to enter the charging pile with a second posture, the second posture being different from the first posture.

2. The washing control method for a cleaning assembly of a cleaning device according to claim 1, wherein after the cleaning device enters the charging pile with the first posture, the cleaning device is in a non-charging state.

3. The washing control method for a cleaning assembly of a cleaning device according to claim 1, wherein the cleaning device entering the charging pile with the first posture comprises:

detecting an indication sign on the charging pile using a sensor on the cleaning device, the indication sign being used to indicate a position of the cleaning device on the charging pile; and controlling, based on the indication sign, the cleaning device to move to a target position on the charging pile with the first posture.

4. The washing control method for a cleaning assembly of a cleaning device according to claim 1, wherein controlling the washing assembly on the charging pile to perform the washing task on the cleaning assembly of the cleaning device comprises:

controlling the washing assembly to perform a water discharging operation for washing the cleaning assembly;

controlling the cleaning device to remove water from the cleaning assembly; and controlling the washing assembly to perform a water pumping operation for pumping out wastewater, wherein the wastewater is generated after the cleaning assembly is washed.

5. The washing control method for a cleaning assembly of a cleaning device according to claim 4, wherein the washing assembly comprises a clean water tank, a washing tank, and a water level monitoring module; and controlling the washing assembly to perform the water discharging operation comprises:

controlling the clean water tank in the washing assembly to perform the water discharging operation for injecting water into the washing tank, monitoring a water level of the washing tank by the water level monitoring module, and stopping the water discharging operation when it is monitored that the water level of the washing tank reaches a preset water level.

6. The washing control method for a cleaning assembly of a cleaning device according to claim 4, wherein controlling the cleaning device to remove the water from the cleaning assembly comprises:

controlling the cleaning assembly to rise to a preset height so that the cleaning assembly is isolated from the washing assembly; and controlling the cleaning assembly to rotate at a preset rotation speed for water removal.

7. The washing control method for a cleaning assembly of a cleaning device according to claim 4, wherein the washing assembly comprises a wastewater tank; and controlling the washing assembly to perform the water pumping operation for pumping out the wastewater comprises:

controlling the washing assembly to pump out the wastewater, and storing the wastewater into the wastewater tank.

8. The washing control method for a cleaning assembly of a cleaning device according to claim 1, further comprising:

in response to the washing task being not the last washing task of the cleaning process and the washing task being completed, controlling the cleaning device to perform a subsequent house cleaning task.

9. The washing control method for a cleaning assembly of a cleaning device according to claim 1, wherein controlling the cleaning device to enter the charging pile with the second posture comprises:

controlling the cleaning device to move toward a front surface of the charging pile with the first posture, wherein the front surface of the charging pile is a surface provided with an entrance, and the cleaning device enters the charging pile through the entrance; and when a distance between the cleaning device and the charging pile is less than a preset distance, controlling the cleaning device to move toward the front surface of the charging pile with the second posture for entering the charging pile.

10. The washing control method for a cleaning assembly of a cleaning device according to claim 9, wherein, when the distance between the cleaning device and the charging pile is less than the preset distance, controlling the cleaning device to move toward the front surface of the charging pile with the second posture for entering the charging pile comprises:

if the cleaning device fails to enter the charging pile within a preset duration, controlling the cleaning device to perform a voice error reporting operation.

11. The washing control method for a cleaning assembly of a cleaning device according to claim 9, wherein the charging pile comprises a charging module; and after controlling the cleaning device to move toward the front surface of the charging pile with the second posture for entering the charging pile, the method further comprises:

acquiring power information about the cleaning device, and if the power information is less than a preset power threshold, controlling the charging module to charge the cleaning device.

12. The washing control method for a cleaning assembly of a cleaning device according to claim 9, wherein the washing assembly comprises an air exhaust module; and after controlling the cleaning device to move toward the front surface of the charging pile with the second posture for entering the charging pile, the method further comprises:

controlling the air exhaust module to dry the cleaning assembly.

13. An electronic device, comprising:

a processor; and a memory, for storing an instruction executable by the processor, wherein the processor is configured to execute the executable instruction to perform the washing control method for a cleaning assembly of a cleaning device according to claim 1.

14. A control method for a cleaning system, wherein the cleaning system comprises a cleaning device and a charging pile, and the method comprises:

acquiring a current working state of the cleaning device;

after determining that the cleaning device is in a preset working state, determining a relative position of the cleaning device with respect to the charging pile;

applying a driving force to a driving wheel of the cleaning device based on the relative position, so that the cleaning device is controlled to move with respect to the charging pile or to be kept at the charging pile;

after determining that the cleaning device is in the preset working state, monitoring a movement state of the charging pile;

after the movement state of the charging pile changes, performing a repositioning process by using the cleaning device; and updating a pre-stored position of the charging pile based on a repositioning result.

15. The method according to claim 14, wherein determining that the cleaning device is in the preset working state comprises: determining that the cleaning device is in the preset working state if the cleaning device is in at least one of the following working states:

collecting garbage in a dust box of the cleaning device into a dust collecting chamber of the charging pile; and cleaning a cleaning assembly of the cleaning device by a washing assembly on the charging pile.

16. The method according to claim 15, wherein applying the driving force to the driving wheel of the cleaning device based on the relative position comprises:

in response that the cleaning device moves to a designated position on the charging pile, applying a first driving force along a direction, in which the cleaning device moves towards the charging pile, to the driving wheel of the cleaning device, wherein the first driving force is a force capable of counteracting a force causing movement of the cleaning device away from the charging pile, and the designated position is associated with the preset working state.

17. The method according to claim 14, wherein determining that the cleaning device is in the preset working state comprises: determining that the cleaning device is in the preset working state if the cleaning device is in at least one of the following working states:

collecting garbage in a dust box of the cleaning device into a dust collecting chamber of the charging pile;

cleaning the cleaning assembly of the cleaning device by a washing assembly on the charging pile; and charging the cleaning device by the charging pile.

18. The method according to claim 14, further comprising:

when it is determined that the cleaning device finishes the preset working state and intends to leave the charging pile, acquiring the relative position of the cleaning device with respect to the charging pile; and after determining that the relative position of the cleaning device with respect to the charging pile does not change, applying a driving force to the driving wheel of the cleaning device at a first rate along a direction in which the cleaning device moves away from the charging pile, wherein the first rate is greater than a rate when the cleaning device is in a normal working state.

19. An electronic device, comprising:

a processor; and a memory, for storing an instruction executable by the processor, wherein the processor is configured to execute the executable instruction to perform the control method for a cleaning system according to claim 14.

* * * * *